United States Patent [19]

Ishii et al.

[11] Patent Number: 5,050,562

[45] Date of Patent: Sep. 24, 1991

[54] APPARATUS AND METHOD FOR CONTROLLING A CAR

[75] Inventors: Junichi Ishii, Katsuta; Matsuo Amano, Hitachi; Nobuo Kurihara, Hitachiota; Takeshi Atago, Katsuta; Junichi Makino, Katsuta, all of Japan

[73] Assignee: Hitachi, Ltd., Tokyo, Japan

[21] Appl. No.: 295,820

[22] Filed: Jan. 11, 1989

[30] Foreign Application Priority Data

Jan. 13, 1988 [JP] Japan ..... 63-3728
Jul. 22, 1988 [JP] Japan ..... 63-181794

[51] Int. Cl.[5] ..... F02D 41/14

[52] U.S. Cl. ..... 123/489; 123/417; 123/480; 123/488; 364/431.05; 364/431.11

[58] Field of Search ..... 123/489, 480, 486, 488, 123/479, 416, 440, 417, 589; 364/431.05, 431.11, 431.12, 431.01

[56] References Cited

U.S. PATENT DOCUMENTS 4,130,095 12/1978 Bowler et al. ..... 123/440
4,413,601 11/1983 Matsuoka et al. ..... 123/440
4,517,948 5/1985 Kaji et al. ..... 123/489
4,542,730 9/1985 Nagasawa et al. ..... 123/489
4,552,115 11/1985 Okino ..... 123/489
4,625,699 12/1986 Kobayashi et al. ..... 123/489
4,644,920 2/1987 Abe et al. ..... 123/479
4,703,430 10/1987 Amano et al. ..... 123/489
4,785,783 11/1988 Oshiage et al. ..... 123/480

FOREIGN PATENT DOCUMENTS 0185552 6/1986 European Pat. Off. .
59-188057 10/1984 Japan ..... 123/416
61-201844 9/1986 Japan ..... 123/489
2162662 2/1986 United Kingdom ..... 123/489

*Primary Examiner*—Andrew M. Dolinar
*Attorney, Agent, or Firm*—Fay, Sharpe, Beall, Fagan, Minnich & McKee

[57] ABSTRACT

A car control apparatus in which correction characteristics indicating whether or not various control constants are proper or not are calculated through loop control of one of the car's operation parameters, such as the air-fuel ratio, on the basis of the air-fuel ratio correction factors subjected to learning to thereby rationalize the control constants such as the fundamental injection time so as to realize proper fuel injection and proper ignition timing control.

11 Claims, 24 Drawing Sheets

NOTE:
2460 TSCMPER WHEN Ts-CHARACTERISTIC IS DISTORTED, FLAG FTSCMPER IS MADE ZERO.

APPARATUS AND METHOD FOR CONTROLLING A CAR

BACKGROUND OF THE INVENTION

The present invention relates to an apparatus and method for controlling a car, and particularly relates to a car control apparatus and method for controlling operation variables of a regulator which regulates the operating condition of a car.

As a typical one of car control apparatus there is known an internal combustion engine control apparatus.

In the internal combustion engine control apparatus, the operation condition of the internal combustion engine is detected, the fuel flow necessary at present is calculated by means of an arithemtic unit, and the injection valve is driven on the basis of the result of the calculation.

In such an internal combustion engine control apparatus, however, there has been a problem in that the secular change in injection valve and/or air flow sensor or variations in manufacturing the same makes it difficult to obtain a proper fuel flow.

To solve such a problem, there has been proposed an apparatus additionally provided with a calibration learning function, for example, as disclosed in U.S. Pat. No. 4,130,095.

According to the calibration learning function, when a correction signal based on an output signal of an oxygen sensor provided in an exhaust system deviates from an ideal state, the amount of deviation is regarded as an amount of the secular change or variations in production and stored in a rewritable memory element. In practice, the above amount of deviation is used as a correction term in a computing equation for determining a fuel flow.

In an internal combustion engine control apparatus, ignition timing control is carried out in addition to the above-mentioned fuel control.

One of basic parameters for determining the ignition timing is the amount of air sucked into an internal combustion engine every cycle.

In such a control apparatus, there are the following problems. One of the problems is that when the output of an air flow amount varies due to secular change or variations in production as described above, it becomes impossible to obtain the ignition timing accurately because the variations in the air flow sensor per se for detecting the amount of air which is one of a basic parameters for determining the ignition timing cannot be detected, while the fuel feed amount can ultimately be corrected by means of the calibration learning function.

A second one of the problems is as follows. In such a control apparatus, control constants for determining the fuel amount etc., are stored in a memory element or electronic memory means so that those control constants are read out from the memory element or electronic memory means to determine the fuel amount in operating the internal combustion engine. In such a control apparatus, however, the control constants to be stored in the memory element or electronic memory means are determined in a manner such that under the condition that the internal combustion engine is being actually operated, values of control constants required for the operation of the engine, for example, the values with which the exhaust harmful components becomes minimum, the values with which the output torque becomes maximum, and the like, are looked-up in various operational regions of the engine to thereby obtain the most optimum values which satisfy the required characteristics while changing the values of control constants again and again artificially. Accordingly, it takes a long time and many hands to finally determine the values of control constants and there is a limit in accuracy of the thus obtained control constants.

SUMMARY OF THE INVENTION

It is an object of the present invention to provide a car control apparatus and method in which the control constants of a control signal for controlling the operation variables of a regulator which regulates the operating condition of a car can be maintained at optimum values.

It is another object of the present invention to provide a car control apparatus and method in which the initial control constants of a control signal for controlling the operation variables of a regulator which regulates the operating conditions of a car can be determined to be optimum values.

The feature of the present invention is that the characteristic correction values indicating whether the control constants are proper or not are obtained on the basis of deviation components of a control system obtained by feedback control and the control constants are corrected to be optimum values on the basis of the characteristic correction values.

BRIEF DESCRIPTION OF THE DRAWINGS

Other features and advantages of the present invention will be apparent from the following description taken in connection with the accompanying drawings, wherein.

DESCRIPTION OF THE PREFERRED EMBODIMENTS

Referring to the accompanying drawings, preferred embodiments of the present invention will be described hereunder.

For a car gasoline engine, it is necessary to collectively control the operating condition so as to reduce the harmful components in the exhaust gas and so as to improve the fuel economy. To this end, there is used an electronic engine control variable regulator (hereinafter referred to as "EEC") in which various signals indicating the operation condition of the engine are fetched from various sensors by means of a controller using a microcomputer so that various control over the fuel feed amount, ignition timing, etc., are carried out on the basis of the fetched signals to thereby realize an optimum engine operating condition.

Figure 1:
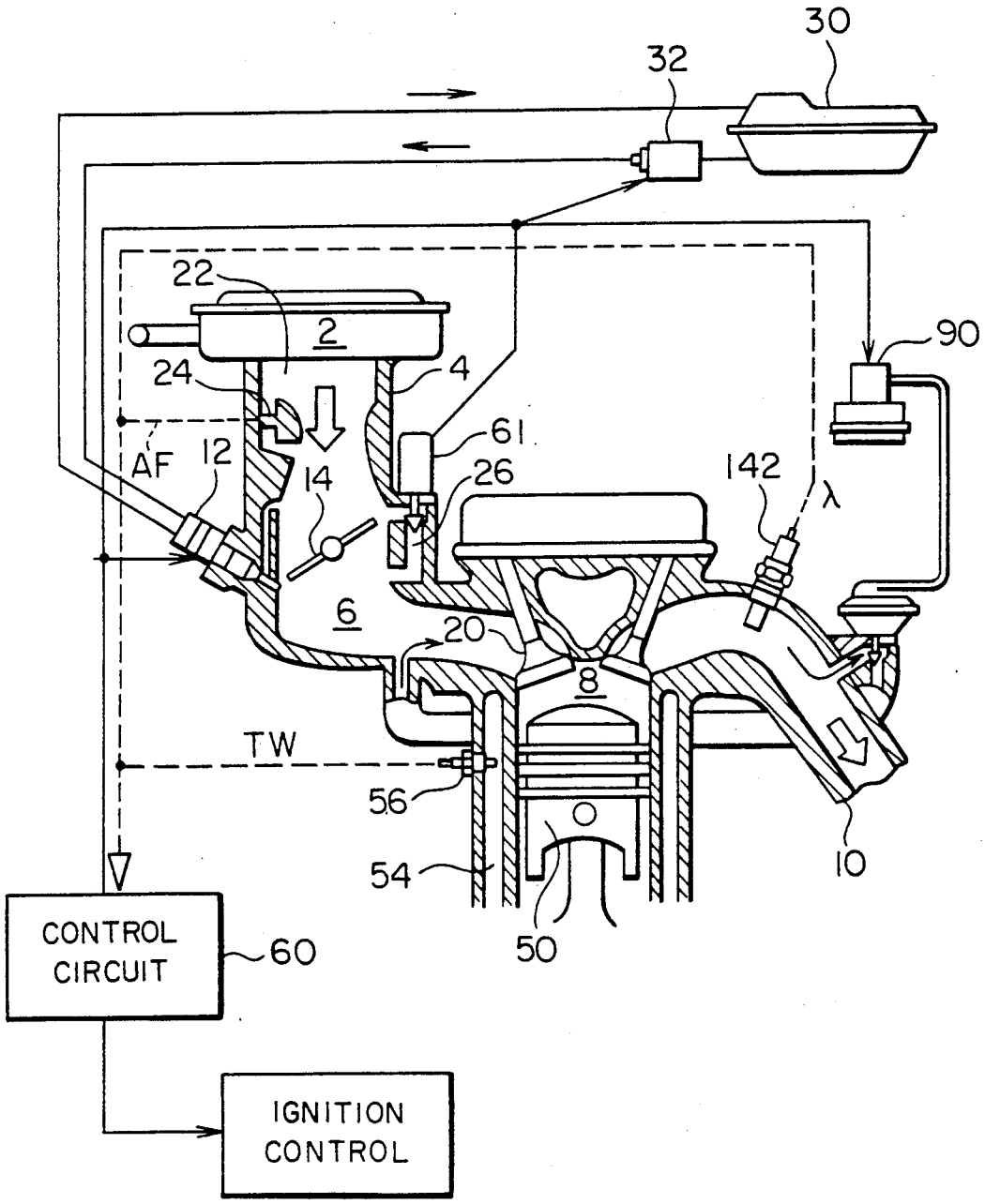
FIG. 1 is a view illustrating the configuration of an embodiment of the present invention.
Figure 2:
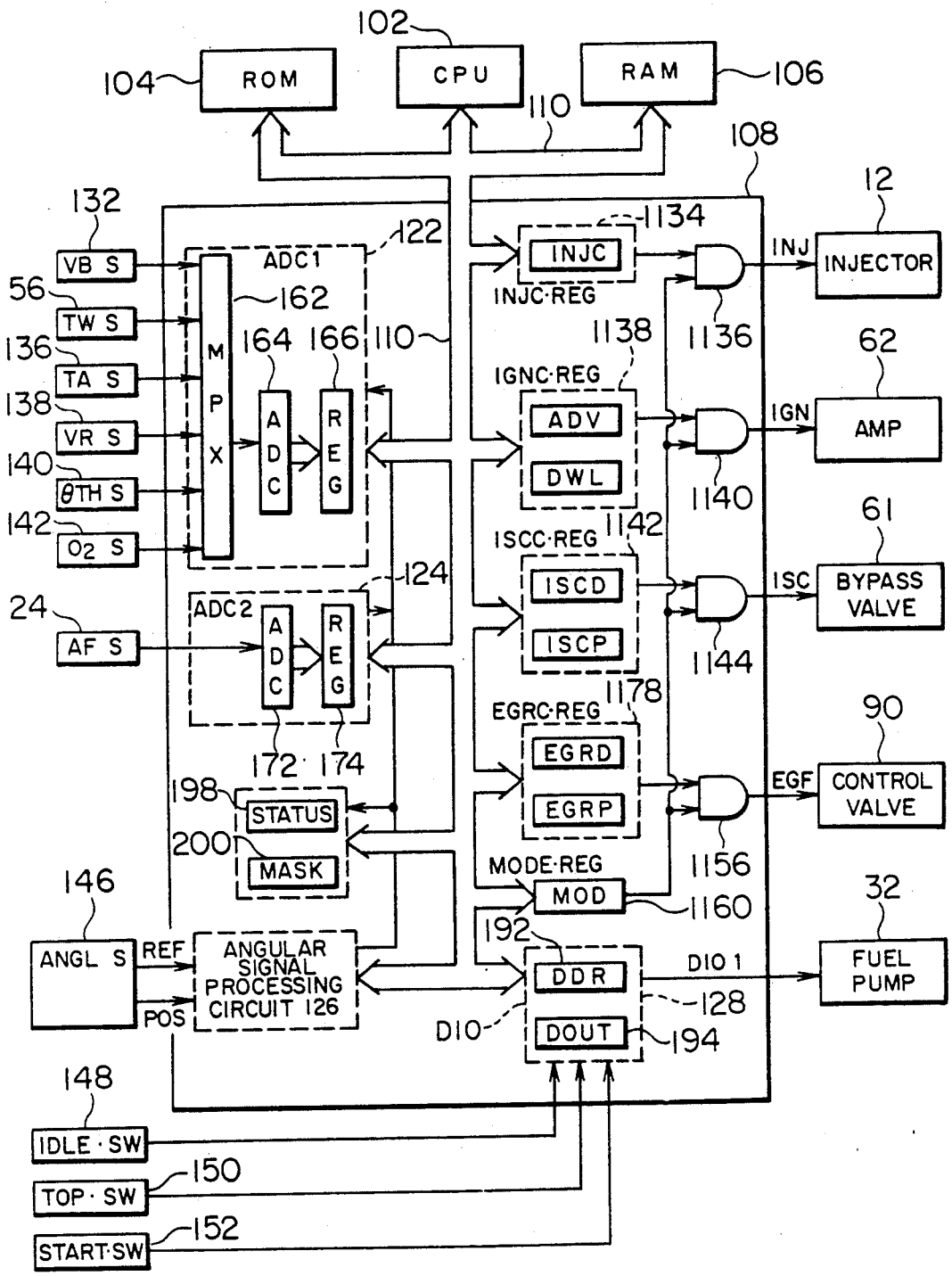
FIG. 2 is a block diagram showing the control in the embodiment of FIG. 1.

Referring to FIGS. 1 and 2, description will be made about an embodiment of the present invention, that is, an example of the control system in which an EEC as described above is applied to a fuel injection type internal combustion engine.

FIG. 1 is a partially cut-away sectional view of the whole of an engine control system. In FIG. 1 the intake air is supplied through an air cleaner 2, a throttle chamber 4 and an intake manifold 6 into a cylinder 8. The gas combusted in the cylinder 8 is exhausted therefrom through an exhaust manifold 10 into the atmosphere.

The throttle chamber 4 contains an injector 12 for injecting the fuel. The fuel injected from this injector 12 is atomized in the air path of the throttle chamber 4, and mixed with the intake air to make up a mixture gas, which is supplied via the intake manifold 6 to the combustion chamber of the cylinder 8 by the opening of the intake valve 20.

A throttle valve 14 is mounted near the outlet of the injector 12, which valve 14 is so constructed as to be mechanically interlocked with the accelerator pedal and driven by the driver.

An air bypass 22 is arranged upstream of the throttle valve 14 of the throttle chamber 4, and contains a hot-wire air flowmeter, that is, a flow rate sensor 24 made of an electrical heat resistance wire to pick up an electrical signal AF changing with the air velocity. Since the flow rate sensor 24 made of a heat resistance wire (hot wire) is arranged in the air bypass 22, it is protected from the high temperature gas at back fire in the cylinder 8 on the one hand and from the contamination by the dust in the intake air on the other hand. The outlet of the air bypass 22 is opened to a point near the narrowest portion of the venturi, while the entrance thereof is open upstream of the venturi.

The injector 12 is supplied with the fuel pressurized through a fuel pump 32 from a fuel tank 30. Upon application of an injection signal from the control circuit 60 to the injector 12, the fuel is injected into the intake manifold 6 from the injector 12.

The mixture gas taken in by way of the intake valve 20 is compressed by the piston 50, and burnt by a spark started on the spark plug (not shown). This combustion energy is converted into kinetic energy. The cylinder 8 is cooled by the cooling water 54. The temperature of the cooling water is measured by water temperature sensor 56, and the resulting measurement TW is used as an engine temperature.

The exhaust manifold 10 has an oxygen sensor 142, which measures the oxygen concentration in the exhaust gas and produces a measurement λ.

The crankshaft not shown carries a crank angle sensor for producing a reference angle signal and a position signal respectively for each reference crank angle and a predetermined angle (such as 0.5 degree) in accordance with the rotation of the engine.

The output of the crank angle sensor, the output signal TW of the water temperature sensor 56, the output signal λ of the oxygen sensor 142, and the electrical signal AF from the hot wire 24 are applied to the control circuit 60 including a microcomputer and the like, an output of which drives the injector 12 and the ignition coil.

Further, a bypass 26 leading to the intake manifold 6 is arranged over the throttle valve 14 in the throttle chamber 4, and includes a bypass valve 61 controlled to open and close.

This bypass valve 61 faces the bypass 26 arranged around the throttle valve 14 and is operated by a pulse current to change the sectional area of the bypass 26 by the lift thereof. This lift drives and controls a drive unit in response to the output of the control circuit 60. Specifically, the control circuit 60 produces a periodical operation signal for controlling the drive unit, so that the drive unit adjusts the lift of the bypass valve 61 in response to this periodical operation signal.

An EGR control valve 90 is for controlling the path communicating between the exhaust manifold 10 and the intake manifold 6 and thus to control the amount of EGR from the exhaust manifold 10 to the intake manifold 6.

In this way, the injector 12 of FIG. 1 is controlled thereby to regulate the air-fuel ratio and the fuel increment, while the engine speed is controlled in an idle state (ISC) by the bypass valve 61 and the injector 12, to which is added the EGR amount control.

FIG. 2 shows the whole configuration of the control circuit 60 using a microcomputer, including a central processing unit 102 (CPU), a read only memory 104 (ROM), a random access memory 106 (RAM), and an input/output circuit 108. The CPU 102 computes the input data from the input/output circuit 108 by various programs stored in ROM 104, and returns the result of computation to the input/output circuit 108. RAM 106 is used as an intermediate storage necessary for the computation. Exchange of data between CPU 102, ROM 104, RAM 106 and the input/output circuit 108 is effected through a bus line 110 including a data bus, a control bus and an address bus.

The input/output circuit 108 includes input means such as a first analog-digital converter 122 (hereinafter called ADC1), a second analog-digital converter (hereinafter called ADC2), 124, an angular signal processing circuit 126 and a discrete input/output circuit (hereinafter called DIO) 128 for inputting and outputting a 1-bit data.

ADC1 includes a multiplexer (hereinafter called MPX) 162 supplied with outputs from a battery voltage sensor (hereinafter called VBS) 132, a cooling water temperature sensor (hereinafter called TWS) 56, an atmospheric temperature sensor (hereinafter called TAS) 136, a regulation voltage generator (hereinafter called VRS) 138, a throttle sensor (hereinafter called OTHS) 140 and an oxygen sensor (hereinafter called $O_2S$), 142. MPX 162 selects one of the inputs and applies it to an analog-digital converter circuit (hereinafter called ADC) 164. A digital output of the ADC 164 is held in a register (hereinafter called REG) 166.

The output of a flow rate sensor (hereinafter called AFS) 24, on the other hand, is applied to ADC2 124, and converted into a digital value through an analog-digital converter circuit (hereinafter called ADC) 172 and is set in a register (hereinafter called REG) 174.

An angle sensor (hereinafter called ANGLS) 146 produces a signal representing a reference crank angle such as 180 degree (hereinafter called REF) and a signal representing a small angle such as 1 degree (hereinafter POS) and applies them to an angular signal processing circuit 126 for waveform shaping.

DIO 128 is supplied with signals from an idle switch 148 (hereinafter called IDLE-SW) which operate when the throttle valve 14 is returned to the full-closed position, a top gear switch (hereinafter called TOP-SW) 150 and a starter switch (hereinafter called START-SW) 152.

Now, a circuit for producing a pulse based on the result of computation of the CPU and objects of control will be explained. An injector control circuit (hereinafter called INJC) 1134 is for converting a digital computation result into a pulse output. A pulse INJ having a duration corresponding to the fuel injection amount is produced by INJC 1134 and applied through an AND gate 1136 to the injector 12.

An ignition pulse generator circuit (hereinafter called IGNC) 1138 includes a register (hereinafter called ADV) for setting an ignition timing and a register (hereinafter called DWL) for setting an ignition coil primary current start timing. These data are set by the CPU. The pulse ING is generated on the basis of the data thus set, and is applied through an AND gate 1140 to an amplifier 62 for supplying a primary current to the ignition coil.

The opening rate of the bypass valve 61 is controlled by a pulse ISC applied thereto through the AND gate 1144 from a control circuit 1142 (hereinafter called ISCC). ISCC 1142 has a register ISCD for setting a pulse duration and a register ISCP for setting a pulse period.

An EGR amount control pulse generator circuit (hereinafter called EGRC) 1178 for controlling the EGR control valve 90 includes a register EGRD for setting a value representing a duty cycle of the pulse and a register EGRP for setting a value representing a pulse period. The output pulse EGR of this EGRC is applied through the AND gate 1156 to a transistor 90.

The 1-bit input/output signal, on the other hand, is controlled by the circuit DIO 128. Input signals include the IDLE-SW signal, the START-SW signal and the TOP-SW signal, while the output signals include a pulse output signal for driving the fuel pump. This DIO includes a register DDR 192 for determining whether or not a terminal is used as an input terminal and the register DOUT 194 for latching the output data.

A mode register (hereinafter called MOD) 1160 is for holding commands for specifying various conditions in the input/output circuit 108. By setting a command in this mode register 1160, for example, all the AND gates 1136, 1140, 1144 and 1156 can be actuated or deactivated as desired. It is thus possible to control the start and stop of the output of the INJC, IGNC and ISCC by setting a command in the MOD register 1160.

DIO 128 produces a signal DIO1 for controlling the fuel pump 32.

In the EEC illustrated in FIGS. 1 and 2, the fuel injection by means of the injector 12 is carried out periodically in synchronism with the rotation of the engine, and the control of the fuel injection amount is performed by controlling the valve opening time of the injector 12, that is, the fuel injection time $T_i$ in one fuel injection operation.

In the embodiment of the present invention, the fuel injection time $T_i$ is basically determined as follows.

$$T_i = \alpha \cdot T_p \cdot (K_l + K_t - K_s) + T_s \quad (1)$$

$$T_p = K_{const} \cdot \frac{Q_a}{N} \quad (2)$$

where $K_{const}$ represents an injector factor, $T_p$ a fundamental fuel injection time, $\alpha$ air-fuel ratio correction factor, $T_s$ ineffective fuel injection time, $K_l$ a steady-state learning factor, $K_t$ a transient-state learning factor, $K_s$ an ineffective fuel injection time factor, $Q_a$ an intake air flow rate, and N the engine speed.

That is, the fundamental fuel injection time $T_p$ is determined on the basis of the engine intake air flow rate $Q_a$ and the engine speed N in accordance with the equation (2) so as to briefly obtain the theoretical air-fuel ratio (A/F=14.7), and the air-fuel ratio correction factor $\alpha$ is corrected on the basis of the signal $\lambda$ of the oxygen sensor 142 so as to correct the air-fuel ratio by means of feedback to thereby obtain more accurate theoretical air-fuel ratio. Thereafter, variations in characteristics and/or secular changes of various actuators and sensors related to the air-ruel ratio control are compensated on the basis of the steady-state learning factor $K_l$, acceleration and deceleration characteristics are corrected on the basis of the transient-state learning factor $K_t$, and the shift factor is subtracted from the resultant in rapid deceleration operation. Thus, the fuel injection time $T_i$ is determined.

Let the output signal of the oxygen sensor 142 be represented by by $\lambda$. This signal $\lambda$ is produced in digital form (taking a high-level or low-level value alone) according to the presence or absence of oxygen in the exhaust gas. In order to permit an air-fuel ratio control on the basis of the digital signal, the output signal $\lambda$ of the oxygen sensor 142 is checked, and the control factor $\alpha$ is changed stepwise upward or downward each time the output signal $\lambda$ changes from high (air-fuel ratio on rich side) to low level (air-fuel ratio on lean side) or from low level to high level, followed by a gradual increase or decrease thereof.

Figure 3:
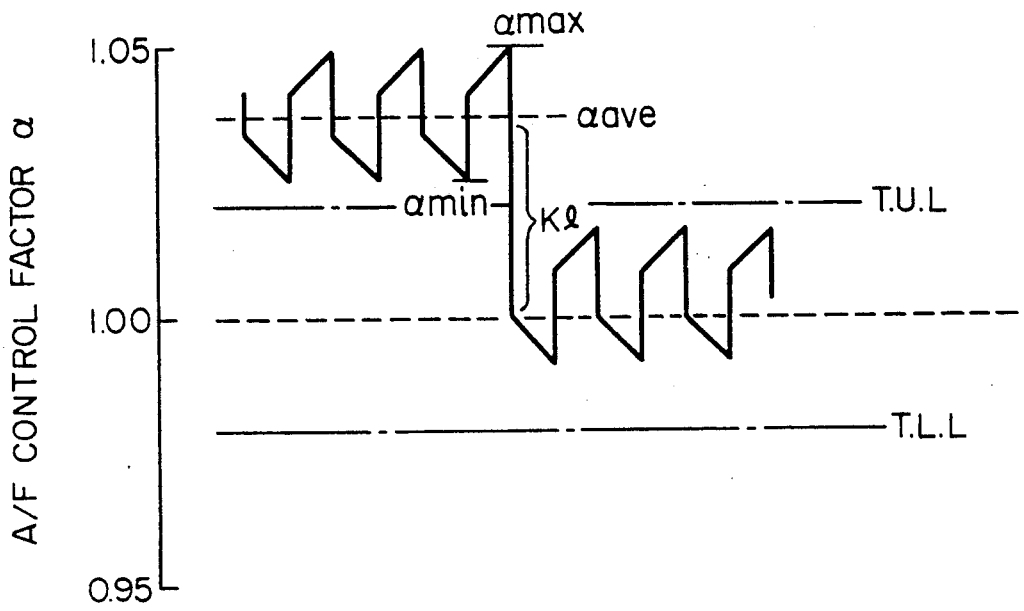
FIG. 3 is a diagram for explaining an A/F correction factor.

The manner of change in the control factor $\alpha$ according to the rich or lean state of the signal $\lambda$ is shown in FIG. 3.

An extreme value of the control factor $\alpha$ which appears at the time of reversal of the output signal $\lambda$ of the oxygen sensor 142 is checked, so that the extreme value obtained at the time of change from lean to rich state of air-fuel mixture gas is assumed to be $\alpha_{max}$ and the extreme value obtained at the time of change from rich to lean state is assumed to be $\alpha_{min}$. From these values, the average value $\alpha_{ave}$ of the factor $\alpha$ is obtained by the equation below.

$$\alpha_{ave} = \frac{\alpha_{max} + \alpha_{min}}{2} \quad (3)$$

In an embodiment of the present invention, an uppe limit T.U.L and a lower limit T.L.L of this average value $\alpha_{ave}$ are set as shown in FIG. 3, and when the average value $\alpha_{ave}$ deviates from the range between T.U.L and T.L.L, the error between the average value $\alpha_{ave}$ and $\alpha = 1.0$ is taken out and used as a learning factor Kl. The process of taking out this learning factor Kl is performed in all engine operating regions subjected to oxygen feedback control.

Figure 4:
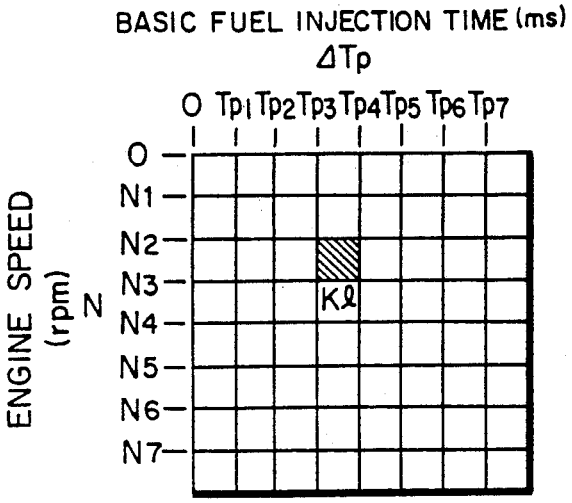
FIG. 4 is a view showing the configuration of a memory map for learning.

FIG. 4 shows an example of the memory map for writing the learning factor Kl, in which the engine operating regions are determined by the engine speed N and the basic fuel injection time Tp, and each learning factor Kl determined as above is stored therein according to each operating region.

The learning factor Kl is picked up only when and on condition that at least n extreme values of the control factor $\alpha$ (n: a predetermined value such as 5) have appeared continuously while the engine operating conditions remain in the same operating region.

The map of FIG. 4, which is used to store the learning factor Kl used for controlling the fuel injection time Ti steadily according to equation (1), is defined as a steady-state learning map.

Figure 5:
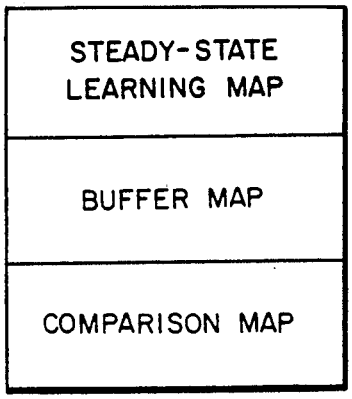
FIG. 5 is a view showing the configuration of a comparison map.

As seen from the map of FIG. 4, according to the embodiment, the basic fuel injection time Tp, which corresponds to engine load as apparent from equation (2), is divided into eight parts from 0 to Tp7, and so is the engine speed from 0 to $N_7$, so that a total of 64 ($=8\times8$) dividing points are obtained and used as engine operating regions. In this embodiment, the learning factors Kl are not directly written or corrected in the steady-state learning map but by use of another two maps including a buffer map and a comparison map as shown in FIG. 5 having the same regional configuration as the steady-state learning map.

A routine for preparation of a steady-state learning map using a plurality of maps as above will be explained with reference to FIGS. 6(A)–6(F).

Figure 6:
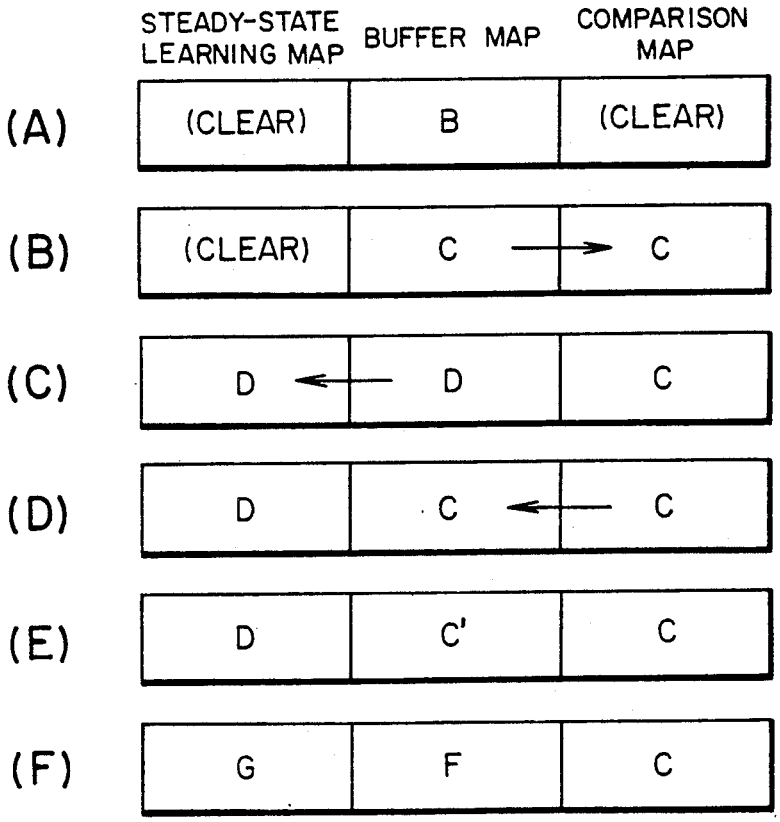
FIGS. 6(A)–6(F) are views shows a map changing process.

Initially, the steady-state learning map and the comparison map are both cleared as shown in FIG. 6 (A). When the engine is operated under this condition and each time the value of the learning factor Kl is determined for each operating region, it is sequentially written in a corresponding area of the buffer map alone. The routine for determining the learning factor Kl in this process will be described later. In this case, the factor Kl in equation (1) is set to 1.0.

The number of the operating regions in which the learning factor Kl is written in the buffer map is increased as the engine contunues to be operated. The learning factors Kl for all the 64 operating regions provided in the map, however, cannot be determined easily by normal engine operation since the operating regions include sufficient margins over actual engine operation.

When the number C of the operating regions where the learning factor K( is written in the buffer map under the condition of FIG. 6 (A) reaches a predetermined value l, therefore, the same data of number C written in the buffer map is also written in the comparison map as shown in FIG. 6 (B). The value ( is determined smaller than the number 64 of the operating regions provided in these maps, and is set to the range from 20 to 30 in this case.

Next, as shown in FIG. 6 (C), with reference to the data in the number of C written in the buffer map, predetermined learning factor Kl is written in all the operating regions to complete the whole buffer map. This state is expressed by D in the drawing. This data D is transferred to the steady-state learning map, followed by a transfer to the buffer map of the data C which has thus far been stored in the comparison map as shown in FIG. 6 (D).

As a result, all of the regions of the steady-state learning map are stored with the learning factor Kl, so that the fuel injection time Ti begins to be controlled according to equation (1) using the learning factor Kl of the steady-state learning map at the time point when the condition of FIG. 6 (D) is obtained. Up to this time, the calculation of equation (1) is conducted with the constant 1.0 as the learning factor Kl.

After the engine control has been entered with the steady-state learning map in this manner, the learning factors Kl in the steady-state learning map and the buffer map are corrected by a new factor as shown in FIG. 6 (E) each time a new learning factor Kl is obtained by the learning in a corresponding operating region as shown in FIG. 3, thus changing the data D and C to D′ and C′ respectively. Each time the correction is made by the new factor (in the case of the buffer map, not only the correction but also the new writing in the operating regions that have not thus far been written with any learning factor), the control factor $\alpha$ is temporarily made 1.0, and the data C′ written in the buffer map is compared with the data C stored in the comparison map to check to see whether or not the difference in the number of factors in respective regions reaches a predetermined number m. If it has reached the number m, the data F of the buffer map of FIG. 6 (F) is transferred to the comparison map as shown in FIG. 6 (B). Then, as shown in FIG. 6 (C), on the basis of the value of the data in the regions already corrected, the factors of all the regions are corrected and written in the steady-state learning map. The routine of FIGS. 6(B) to 6(D) is repeated. In other words, FIG. 6 (F) indicates the processes from 6(B) to 6(D) sequentially conducted. The number m mentioned above is a predetermined value such as 10 smaller than number l.

According to this embodiment, the air-fuel ratio can be controlled while maintaining the average value of the control factor $\alpha$ always near 1.0 by the learning factor K , resulting in a high responsiveness to fully prevent the exhaust gas from deteriorating during the transient state. In addition, the decision of the time point where the steady-state learning map is to be rewritten by learning is very rationally made by comparison between the buffer map and the comparison map, so that the learning becomes possible accurately meeting the aging of the characteristics of the parts, thus keeping the exhaust gas characteristic uniform over a long period of time.

According to the present embodiment, in the regions of the steady-state learning map shown in FIG. 4 where the basic fuel injection time Tp is Tp7 or more and the engine speed N is $N_7$ or more, the learning factor Kl in the regions in the column to the extreme right in the lowest line of the map is used for control, and therefore an optimum power correction is automatically effected all the time even when the engine operating conditions enter the power running area.

Figure 7:
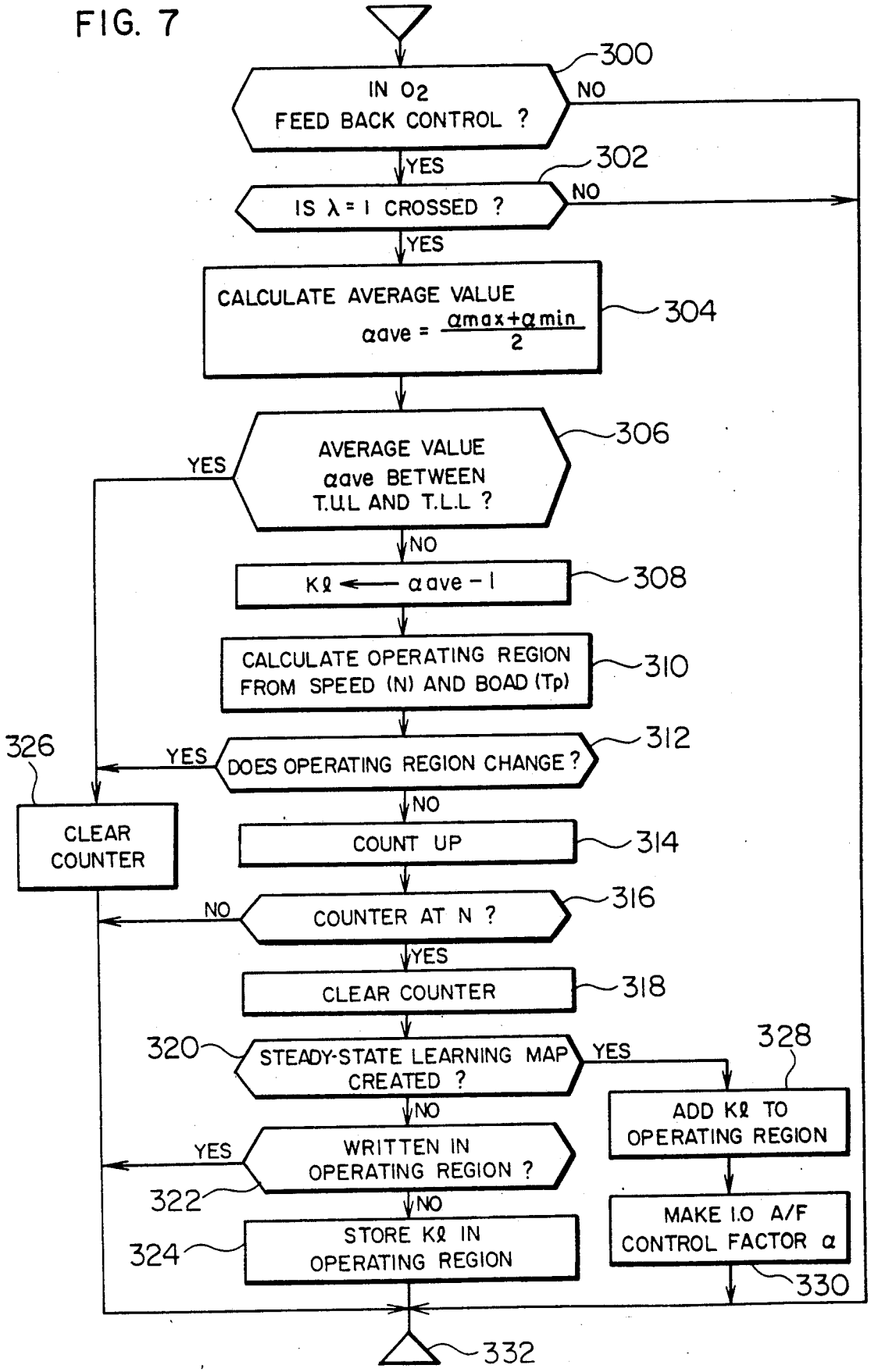
FIG. 7 is a flowchart of a learning routine.
Figure 8:
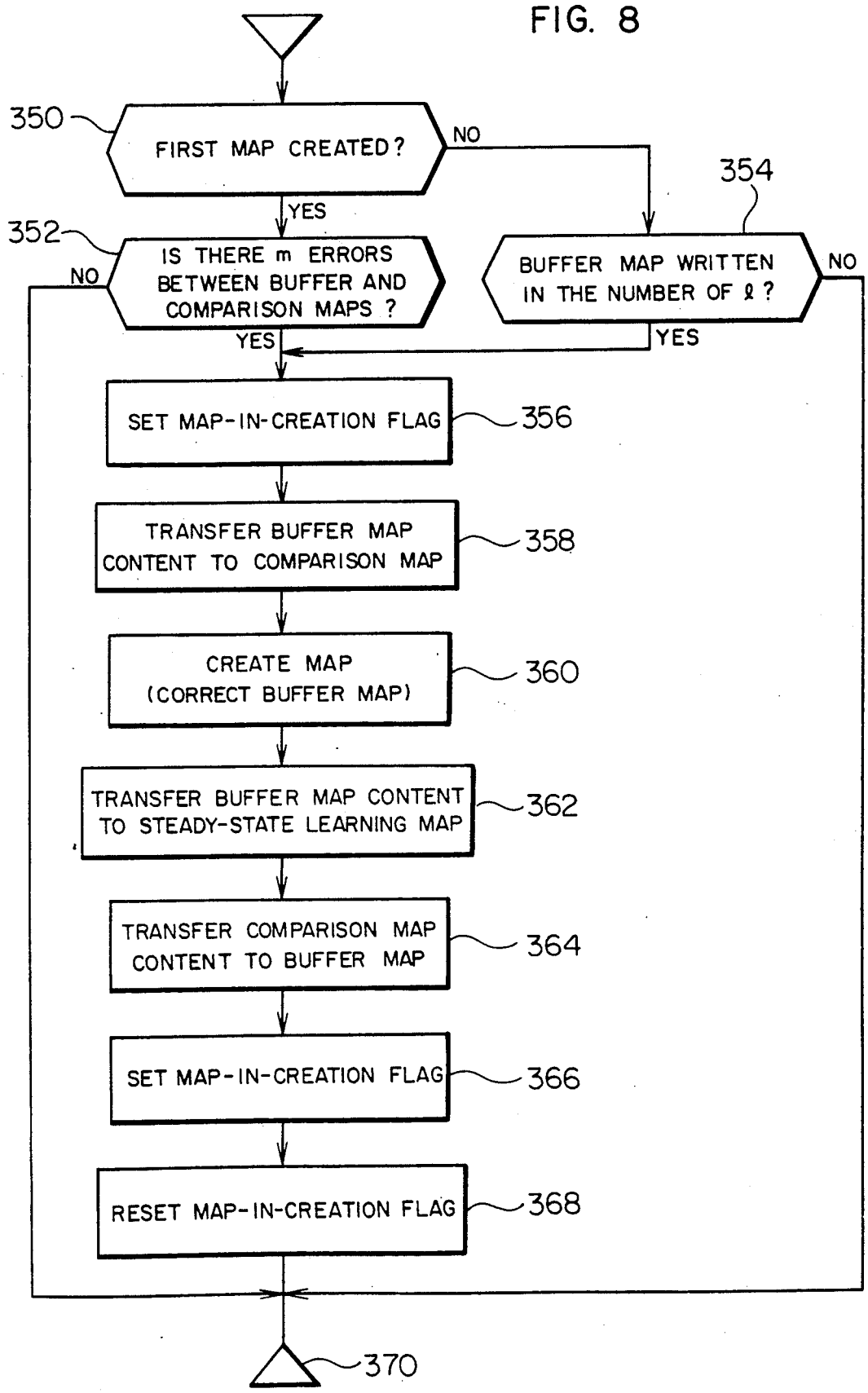
FIG. 8 is a flowchart of a map changing routine.

Now, an embodiment of the learning routine of the learning factor Kl and the routine for executing the process shown in FIG. 6 will be explained with reference to the flowcharts of FIGS. 7 and 8.

The process according to these flowcharts is repeated at regular intervals of time such as 40 msec after engine start. First, in FIG. 7, step 300 decides whether or not the oxygen feedback control has been started, and if the result is "Yes", the process is passed to step 302. If the answer is "No", by contrast, the process proceeds to step 332. At step 302, whether or not the signal of the oxygen sensor has crossed the level of $\lambda=1$ (air-fuel ratio A/F of 14.7). If the answer is "No", the process is passed to step 332 where the well-known integrating process is performed (the process for determining the change in the incrementing and decrementing portions of the control factor $\alpha$). If the result is "Yes", the process is passed to step 304, where the average value $\alpha_{ave}$ shown in equation (3) is calculated. Step 306 decides whether or not the average value $\alpha_{ave}$ is included in the range between upper and lower limits shown in FIG. 3, and if it is included, it indicates that normal feedback control is effected so that the counter is cleared at step 326 and the process is passed to step 332.

If the average value $\alpha_{ave}$ is not included in the range between upper and lower limits, by contrast, the error between the average value $\alpha_{ave}$ and unity is determined as a learning compensation amount Kl at step 308. Then, step 310 calculates the present operating region determined from the basic fuel injection time Tp and the engine speed N shown in FIG. 4, followed by step 312 where it is compared with the immediately preceding operating region of the routine to decide whether or not the operating region has undergone a change. If it is found that the operating region has changed, that is, when the answer is "Yes", an operating region is not determined where the learning compensation amount Kl is to be written, and therefore the process is passed to step 326. If the operating region remains unchanged, on the other hand, the counter is counted up at step 314, followed by step 316 to decide whether or not the counter has reached n. If the count is not n, that is, when the answer is "No", the process proceeds to step 332. If the count is found to have reached n, by contrast, that is, when the answer is "Yes", step 318 clears the counter, and the process is passed to step 320.

Step 320 decides whether or not the first steady-state learning map has been prepared by the operation from FIG. 6(B) to FIG. 6(D). If the map is not yet prepared, the process proceeds to step 322 and so on to perform the operation of FIG. 6(A). Step 322 decides whether or not the factor Kl has already been written in the operating region involved. If it is already written, that is, when the answer is "Yes", the process is passed to step 332 without any further process. If the result is "No", on the other hand, step 324 writes the learning compensation amount Kl calculated at step 308 in the operating region involved. If it is found that the first steady-state learning map has been prepared, or the answer is "Yes" at step 320, then the process is passed to step 328 and so on to perform the operation of FIGS. 6(E) and 6(F) as already explained. Step 328 adds the learning compensation amount Kl to the dividing point of the steady-state learning map and the buffer map, followed by step 330 where the air-fuel ratio compensation factor is made 1.0.

By repeating the processes according to steps 300 to 322, the operations of FIGS. 6(A), 6(E) and 6(F) are performed.

Now, the operations of FIGS. 6(B), 6(C) and 6(D) will be described with reference to the flowchart of FIG. 8.

Step 350 decides whether or not the first steady-state learning map has been prepared, and if it has not yet been prepared, that is, when the answer is "No", the process is passed to step 354 to check the number of regions written of the buffer map. If the number has reached (, the process is passed to step 356, while the process proceeds to step 370 in the opposite case. If the steady-state learning map is found to have been prepared that is, when the answer is "Yes" at step 350, step 352 checks the difference between the data on the buffer map and the comparison map. If there is a difference of m between the data between buffer map and comparison map, the process proceeds to step 356 to prepare a steady-state learning map. If the data difference is less than m, by contrast, the process is passed to step 370.

At step 356, the flag in the process of preparing a map is set to prohibit the writing of the learning result. Step 358 transfers the data in the buffer map to the comparison map, followed by step 360 where the steady-state map is prepared by use of the buffer map. Step 362 transfers the data of the buffer map thus prepared to the steady-state learning map, followed by step 364 where the data of the comparison map is transferred to the buffer map. Step 366 sets the flag meaning that the steady-state learning map has been prepared. This flag is used for decision at step 350 and step 320 is FIG. 7. Step 368 resets the flag indicating the process of map preparation set at step 356.

The foregoing is a process for forming the steady-state learning factor owing to the $O_2$ feedback control by use of an $O_2$ sensor and the steady-state learning of the air-fuel ratio correction factor. The learning factor is used in determining the secular-change correction factor and control constants which will be described later.

Next, description will be made about the main portion of the embodiment of the present invention, that is, the characteristic indexes obtained on the basis of the learning factors in the two different operating conditions and the operation of the device for correcting the secular change correction factors and control constants by making reference to the characteristic indexes.

First, let the condition where the control constants do not accord with the physical characteristics of the engine, sensors and actuators be called "unmatched condition". Assuming that the learning is in the steady-state non-learned state where the learning factors of the equation (1) are $Kl=1.0$, $K_t=0$, and $K_s=0$, the fuel injection time is expressed by the following equation (4) by use of the injector factor $K_{const}$, the ineffective fuel injection time $T_s$, and the air flow characteristic $Q_a$ in the unmatched condition.

$$T_i = K_{consr} Q_a / N \cdot \alpha + T_s \quad (4)$$

This state can be expressed by use of matched values $K_{const}$, $Q_a^*$, and $T_s^*$ as follows in the equation (5) in which the feedback factor $\alpha$ is deleted.

$$T_i = K_{const}^* \cdot Q_a^* / N + T_s \quad (5)$$

From the equations (4) and (5), the following equation (6) is established.

$$K_{consr} Q_a / N \cdot \alpha + T_s = K_{const}^* \cdot Q_a^* / N + T_s \quad (6)$$

Arranging the equation (6) by use of $T_p^* = K_{const}^* \cdot Q_a^* / N$, the following equation (7) is established.

$$Kl(N, T_p^*) = E1 \cdot E2 \cdot E3 \quad (7)$$

$$E1 = (T_s^* - T_s)/T_p + 1.0 \quad (8)$$

$$E2 = K_{const}^* / K_{const} \quad (9)$$

$$E3 = Q_a^* / Q_a \quad (10)$$

From the equations (7)-(10), it can be understood that the following components are reflected to the Kl in the form of products as follows:

$T_s$; $E_1$ (mainly the function of $T_p^*$, see FIG. 13)

$K_{const}$; E2 (constant)

$Q_a$; E3 (function of $Q_a$)

Figure 9:
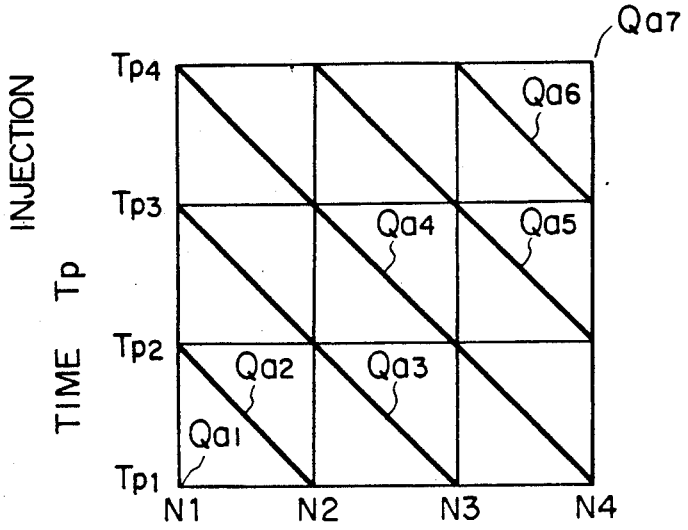
FIG. 9 is a view showing the configuration of a map.

Next, $K_l(N, T_p^*)$ will be considered in the case where the N, $T_p^*$ are divided so that the iso air-flow lines are arranged diametrically as shown in FIG. 9 ($Q_{al}$-$Q_{a7}$). For the sake of simplicity, a map of 4×4 is considered, and let the learning values be the intersections.

Then, the errors E for various factors in the unmatched condition are as follows in accordance with the equation (7). With respect to E1:

| $T_p^*$ | $T_{p1}$ | $T_{p2}$ | $T_{p3}$ | $T_{p4}$ |
|---|---|---|---|---|
| E1 | a1 | a2 | a3 | a4 |

With respect to E2:

$$K_{const}^* / K_{const} = b1$$

With respect to E3:

| Q | Q1 | $Q_a2$ | $Q_a3$ | $Q_a4$ | $Q_a5$ | $Q_a6$ | $Q_a7$ |
|---|---|---|---|---|---|---|---|
| $Q_a^*/Q_a$ | c1 | c2 | c3 | c4 | c5 | c6 | c7 |

Accordingly, the map of $K_l$ (N, $T_p^*$) at this time becomes as shown in following Table 1.

TABLE 1

| | | | | | |
|---|---|---|---|---|---|
| $T_p4$ ... | a4 · b1 · c4 | a4 · b1 · c5 | a4 · b1 · c6 | a4 · b1 · c7 | = M11 M12 M13 M14 |
| $T_p3$ ... | a3 · b1 · c3 | a3 · b1 · c4 | a3 · b1 · c5 | a3 · b1 · c6 | = M21 M22 M23 M24 |
| $T_p2$ ... | a2 · b1 · c2 | a2 · b1 · c3 | a2 · b1 · c4 | a2 · b1 · c5 | = M31 M32 M33 M34 |
| $T_p1$ ... | a1 · b1 · c1 | a1 · b1 · c2 | a1 · b1 · c3 | a1 · b1 · c4 | = M41 M42 M43 M44 |
| | ⋮ | ⋮ | ⋮ | ⋮ | |
| | N1 | N2 | N3 | N4 | = M |

As seen in the Table 1, with respect to the vertical axis $T_p$, the value of E1 changes successively to be a1, a2, . . . ; on the diametrical lines, the values E3 c1, c2, . . . of the unmatched $Q_a$ are multiplied; and to all of the map values, the value b1 of E2 of the unmatched injector factor is multiplied.

The factors of the $K_l$ map are regarded as a matrix and the elements of the matrix are represented by Mij as shown in the Table 1.

The elements of the matrix reflect the matching factors in the form as shown in the Table 1.

Figure 10:
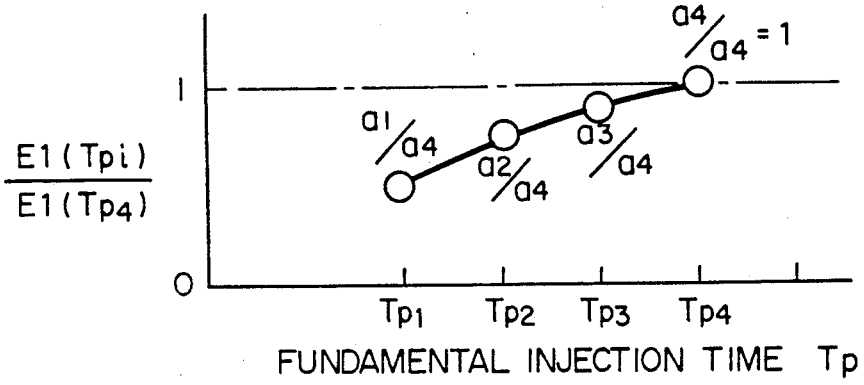
FIG. 10 is a diagram showing the $T_s$ characteristic index.

For example, as shown in FIG. 10, the values a1-a3 which are normalized with the value a4 of E1 at the $T_{p4}$ can be obtained through division as shown in the following Table 2 with respect to the elements of matrix of the $K_l$ map (Table 1).

| | | | |
|---|---|---|---|
| $E1(T_p1)/E1(T_p4)$ = a1/a4 | M44/M11 | — | — |
| $E1(T_p2)/E1(T_p4)$ = a2/a4 | M33/M11 | M34/M12 | — |
| $E1(T_p3)/E1(T_p4)$ = a3/a4 | M22/M11 | M23/M12 | M24/M13 |

Figure 11:
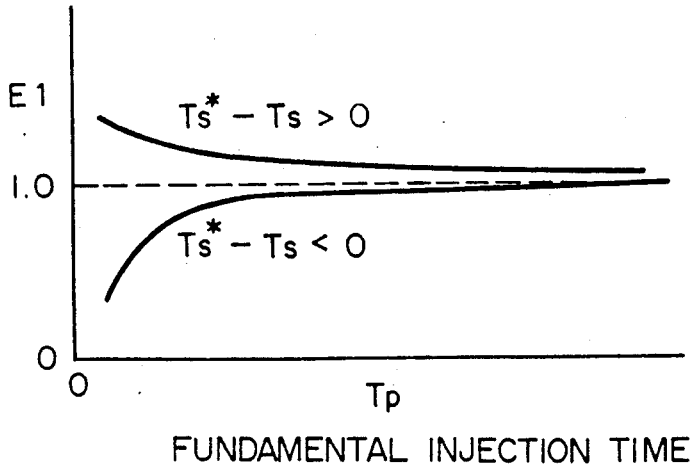
FIG. 11 is a diagram showing the $T_s$ characteristic.

Accordingly, if the characteristic with respect to this $T_p$ is captured, it is possible to correct the ineffective fuel injection time $T_s$ to establish a matched condition, for example, on the basis of the tendency as shown in FIG. 11 (the value of E1 changes largely in proportion to the unmatched amount of the ineffective fuel injection time $T_s$ in the region where the value of the fundamental fuel injection time $T_p$ is small).

That is, first, if the $E1(T_{pi})/E1(T_{p4})$ is obtained by division of the learning value $K_l$ on the iso air-flow lines, the character as shown in FIG. 10 is obtained.

From the relation of equation (11), $$E1 = 1/E1(T_{p4})\{(T_s^* - T_s)/T_p + 1.0\} \quad (11)$$

the values E1 and $(T_s^* - T_s)$ can be deduced by the method of least square by using the respective values of $E1(T_{pi})/E1(T_{p4})$ at the four points $T_{p1}$-$T_{p4}$. Accordingly, the following equation (12) can be obtained.

$$T_s + (T_s^* - T_s) = T_s^* \quad (12)$$

The characteristic of E1 due to $(T_s^* - T_s)$ can be calculated over the whole region of learning.

Accordingly, the influence of E1 on the presently obtained learning value $K_l$ can be eliminated.

That is, the processing at this case can be made to be $K_l \rightarrow K_l'$ ($\because K_l' = K_l / E1(T_{pi})$).

Accordingly, from the equation (7), the characteristic can be obtained as expressed by the following equation (13).

$$K_l(N, T_p^*) = E_2 \cdot E_3 \quad (13)$$

This is the learning value $K_l$ obtained when $T_s = T_s^*$ is established.

Figure 12:
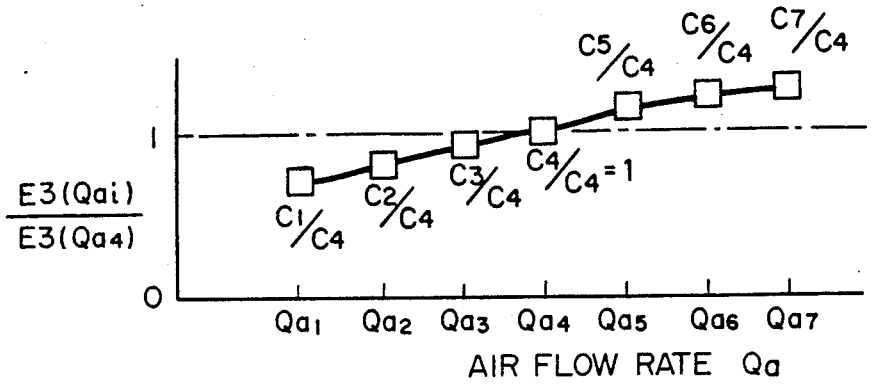
FIG. 12 is a diagram showing the $Q_a$ characteristic index.

FIG. 12 shows the case where the value of $Q_a$ is corrected in the same manner as FIG. 10. The calculation of the matrix (Table 1) is shown in the following Table 3.

| | | | |
|---|---|---|---|
| $E3(Q_a1)/E3(Q_a4)$ = c1/c4 | M41/M44 | — | — |
| $E3(Q_a2)/E3(Q_a4)$ = c2/c4 | M42/M44 | M31/M33 | — |
| $E3(Q_a3)/E3(Q_a4)$ = c3/c4 | M43/M44 | M32/M33 | M21/M22 |
| $E3(Q_a4)/E3(Q_a4)$ = c4/c4 | 1 | 1 | 1 |
| $E3(Q_a5)/E3(Q_a4)$ = c5/c4 | M12/M44 | M23/M22 | M21/M33 |
| $E3(Q_a6)/E3(Q_a4)$ = c6/c4 | M13/M11 | M24/M22 | — |
| $E3(Q_a7)/E3(Q_a4)$ = c7/c4 | M14/M11 | — | — |

Here, in actual, since there is no way to determine the value $E3(Q_{a4})$, the following process is carried out.

$$K_l \rightarrow K_l' (\because K_l' = K_l / E3(Q_{ai}) \cdot E3(Q_{a4}))$$

From the equation (13), the following equation (14) can be obtained.

$$\begin{aligned} K_l'(N, T_p^*) &= E2 \cdot E3/E3 \cdot E3(Q_{a4}) \\ &= E2 \cdot E3(Q_{a4}) \end{aligned} \quad (14)$$

Accordingly, the following relation is established.

$$Q_a = Q_a^* / E3(Q_{a4})$$

$$K_{const} = K_{const}^* \cdot E3(Q_{a4})$$

Therefore, the following relation can be obtained.

$$\begin{aligned} K_{const} \cdot Q_a &= Q_a^* / E3(Q_{a4}) \cdot K_{const}^* \cdot E3(Q_{a4}) \\ &= K_{const}^* \cdot Q_a^* \end{aligned}$$

Taking the thus obtained characteristic into consideration, the matching factors in the unmatched condition are defined as follows.

Klcd2: $K_{const}$ correction factor

Klcd1: $T_s$ correction factor

Klcd3: $Q_a$ correction factor

Taking the equations (4) and (5) into consideration, the matching factors are expressed as follows.

$$Klcd2 = K_{const}^* / K_{const} \quad (15)$$

$$Klcd1 = T_s^* - T_s \quad (16)$$

$$Klcd3 = Q_a^* / Q_a \quad (17)$$

Accordingly, $$K_{const}^* = Klcd2 \cdot K_{const} \quad (18)$$

$$T_s^* = T_s + Klcd1 \quad (19)$$

$$Q_a^* = Klcd3 \cdot Q_a \quad (20)$$

Accordingly, the fuel injection time is expressed as follows.

$$\begin{aligned} T_p &= (Klcd2 \cdot K_{const}) \cdot (Klcd3 \cdot Q_a)/N \\ &= Klcd2 \cdot Klcd3 \cdot T_p \end{aligned} \quad (21)$$

$$\begin{aligned} T_i &= (Klcd2 \cdot K_{const}) \cdot (Klcd3 \cdot Q_a)/N + (T_s + Klcd1) \\ &= Klcd2 \cdot Klcd3 \cdot T_p + (T_s + Klcd1) \end{aligned} \quad (22)$$

According to the equations (21) and (22), the factors to be corrected are distinguished for $K_{const}$, $T_s$ and $Q_a$ in view of the changes affecting $K_l$ due to the $O_2$ feedback, depending on the main causes of generation of the changes. Particularly, the fundamental fuel injection time $T_p$ is corrected with the product of the correction factor Klcd2 of the injector factor $K_{const}$ and the correction factor Klcd3 of the $Q_a$, as shown in the equation (22). Further, the fuel injection time $T_i$ is obtained by adding the battery correction time ($T_s$+Klcd1) to the fundamental fuel injection time $T_p$, as shown in the equation (22).

Consequently, the correction for the fuel injection time, which has been carried out generally with $K_l$, is classified depending on the main causes, and, particularly, the fundamental fuel injection time $T_p$ can be corrected in the manner as shown in the above equation (22). That is, separate learning for every cause can be realized.

Figure 13:
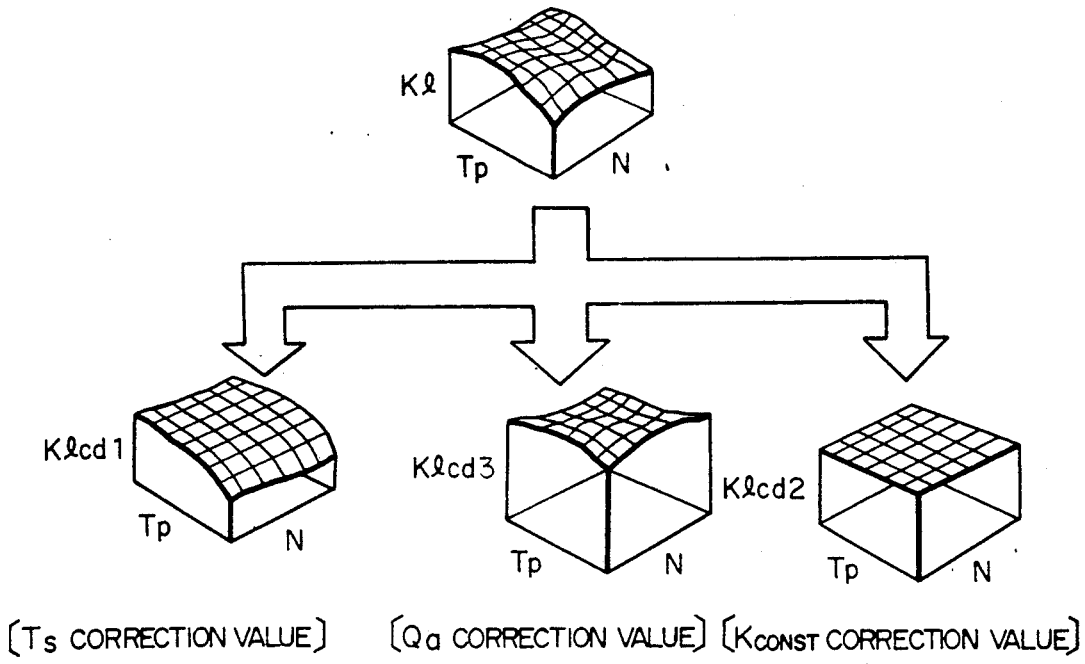
FIG. 13 is a view showing the whole learning value and the learning value for every factor.

As shown in FIG. 13, the learning factor $K_l$ can be separated into the $K_{const}$ correction factor Klcd2, the $T_s$ correction factor Klcd1, and the $Q_a$ correction factor Klcd3.

Figure 14:
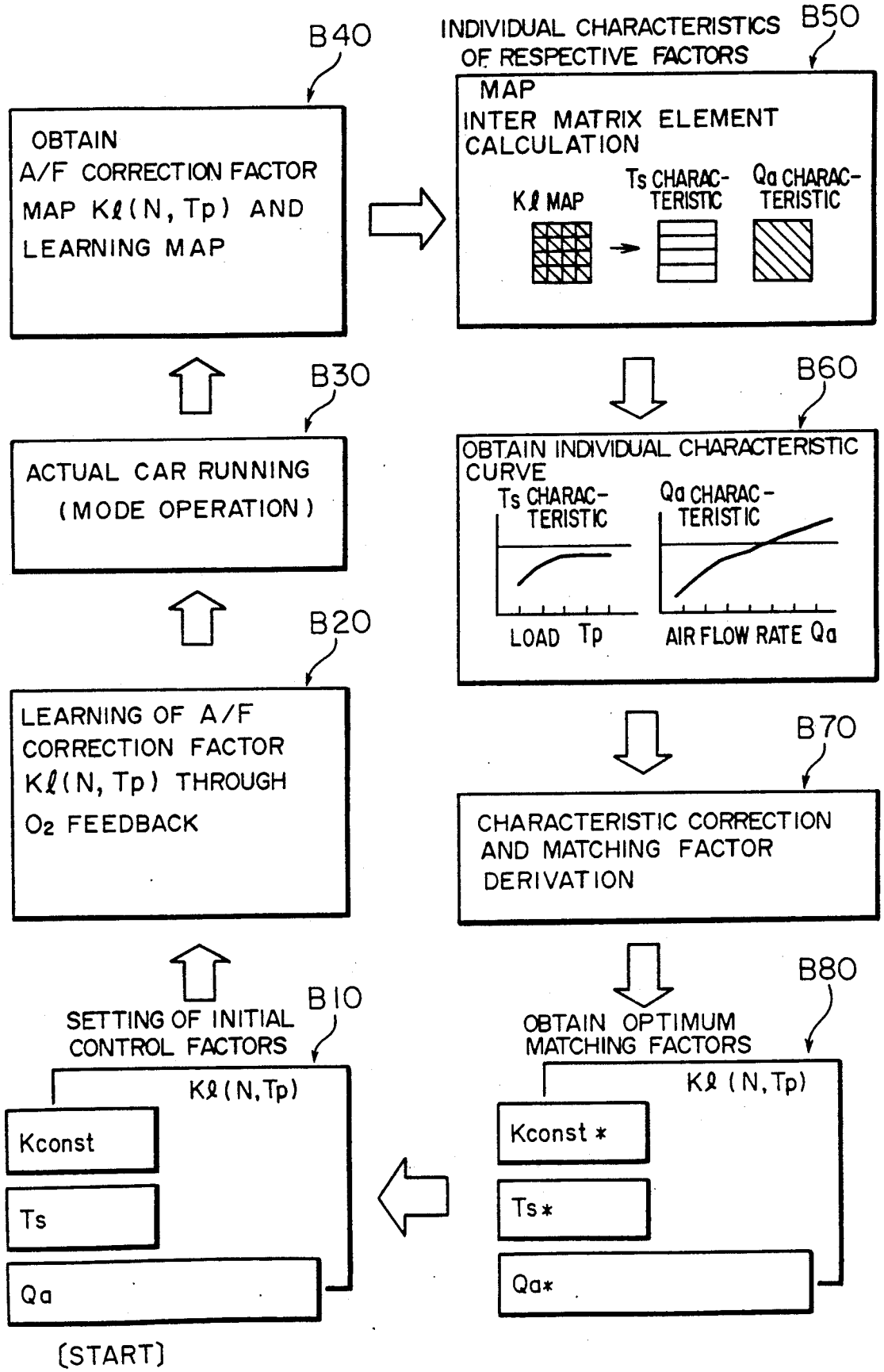
FIG. 14 is a flowchart of correction.

Based on the foregoing analysis, the matching procedure will be described hereunder by making reference to FIG. 14.

First, in the block B10, the respective initial values of $K_{const}$, $T_s$, and $Q_a$ are given. At this time, the $K_l(N, T_p)$ map is in the not-learned state.

Next, in the blocks B20 and B30, the $O_2$ feedback is carried out, various operation conditions (mode operations) are realized, the learning is performed on the $K_l(N, T_p)$ map, so that the $K_l(N, T_p)$ map in the learned state is obtained in the block B40.

Next, in the blocks B50–B80, from the thus obtained $K_l(N, T_p)$ map the separation for every cause as shown in FIG. 13 is performed.

Here, first, the correction on the air flow rate is carried out. From the characteristic of the elements of matrix in the Table 1, it is understood that the values normalized with c4, which is the value of E3 in the case of $Q_{a4}$, can be calculated by division of the elements of matrix as shown in the Table 3. From the Table 3, it is understood that there are several ways of calculation depending on the elements. In the case where learning has been carried out on the $K_l$ map, average processing may be performed when it is judged that the average processing is effective in view of scattering a of values. In the case where learning has been less performed, on the contrary, it will do to carry out correction by obtaining values of irreducible minimum.

That is, with respect to the correction factor Klcd3 of the $Q_a$, correction is made in a manner as shown in the following equations so as to make the relative error constant be 1/c4. Klcd3e represents the value which has been subjected to relative error correction.

$$Klcd3e = ci/c4 \quad (23)$$

$$Q_{ai}^* = Klcd3e \cdot Q_{ai} \quad (24)$$

$$Klcd3 = c4 \cdot Klcd3e \quad (25)$$

At the same time with the foregoing correction on $Q_a$, the diagonal elements of the $K_l$ map are calibrated as shown in the following equation (26). This correction is to be carried out because influence factors on the $K_l$ map have been eliminated through the correction on the $Q_a$ table with the equation (24).

$$Mij = Mij \cdot (c4/ck) \quad (26)$$

$$\text{where } k = j - i + 4 \quad (27)$$

i, j; 1, 2, 3, 4

That is, uniform correction is performed on the diagonal elements in the condition of j−i =constant. As a result, the term related to $Q_a$ in the $K_l$ map becomes ci=c4.

The foregoing may be summarized as follows.

From the $K_l(N, T_p)$ map which has been subjected to learning, the $Q_a$ error characteristic is flattened to form a $Q_a$ correction table. Map correction corresponding to the $Q_a$ correction is performed on the $K_l(N, T_p)$ map.

A method is proposed as follows for correction on $K_{const}$ and $T_s$. That is the way of correction on $T_s$ through division of matrix elements of the $K_l(N, T_p)$ map.

As shown in FIG. 11, in the case where there is unmatching in the ineffective fuel injection time $T_s$ and $(T_s^* - T_s)$ is not "0", the characteristic curve of E1 with respect to $T_p$ becomes a hyperbola and the value of E1 approaches 1 (one) as the value of $T_p$ becomes large. Accordingly, the correction term Klcd1 of $T_s$ is adjusted so as to make the values of a1/a4 and a2/a4 with respect to $T_{p1}$ and $T_{p2}$ in the low load region approach 1 (one) to thereby find an optimum value of $T_s$. Here, for example, in the case where the value of $T_s$ is small, the values of a1/a4 and a2/a4 in a low load region become larger than 1 (one), and therefore operation is made so as to increase the value of Klcd1. In the case where the value of $T_s$ is large, on the contrary, operation is made so as to make the value of Klcd1 small. At this time, if the value of a1/a4 presents a tendency of increase/decrease stably, the degree of increase/decrease of Klcd1 may be set as shown in the following equation (28) in order to raise the converging speed of $T_s$.

$$Klcd1 = Klcd1 + (\text{constant}) \cdot a1/a4 \quad (28)$$

The calculation of factors a1/a4 etc. is as shown in FIG. 11. Assuming that the value of the $K_l(N, T_p)$ map becomes substantially constant $K_{lF}$ when the optimum value of $T_s$ comes into a predetermined range in the foregoing process, and if the common terms are bound so that the respective values of elements become near 1 (one), the following equations are established taking into consideration the conditions of E1=1 of the equation (8) and $E3 = Q_a^*/Q_a$ of the equation (10).

$$K_{const}^*/K_{const} c4 = K_{lF} \quad (29)$$

$$Klcd2 = K_{const}^*/K_{const} \quad (30)$$

From the equation (25), $$Klcd3 = ci = c4(ci/c4) = c4 \cdot Klcd3e \quad (31)$$

From the equations (30) and (31), the following equation (32) is established.

$$Klcd2 \cdot Klcd3 = K_{const}^*/K_{const} c4 \cdot Klcd3e \quad (32)$$

Substituting the equation (29) into the equation (32), the following equation (33) is established.

$$Klcd2 \cdot Klcd3 = K_{lF} \cdot Klcd3e \quad (33)$$

The foregoing may be summarized as follows.

That is, a characteristic value which becomes a function of $T_p$ is calculated depending on the unmatched value of $T_s$ from the revised $K_l$ map, and the $T_s$ correction value is normalized by use of the calculated characteristic value as a reference.

Next, a product of an uniform error of $Q_a$ and an error rate of $K_{const}$ is obtained by use of the values of common factors in the $K_l$ map substantially flattened by the foregoing operation. Through the foregoing operation, the values of $T_s$ and $K_{const}$ can be calibrated.

Thus the normalization of the control constants can be realized by repeating the foregoing operation.

Further, since the control constants can be normalized, the calculation of the fundamental fuel injection time can be normalized so as to make the setting of ignition time proper to thereby make it possible to realize proper engine control collectively.

Figure 15:
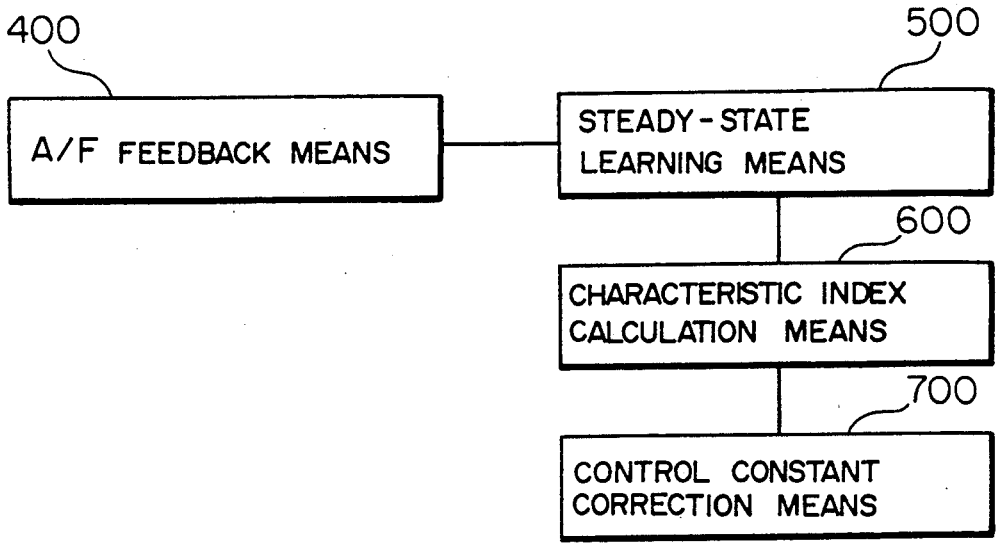
FIG. 15 is a block diagram for explaining the operation function.

Specific operation of the embodiment will be described hereunder. FIG. 15 shows a control constant correction device. An air-fuel ratio feedback means 400 generates an air-fuel ratio correction factor $\alpha$ through $O_2$ feedback. A steady-state learning means 500 carries out the steady learning shown in FIGS. 7 and 8 so as to make learning on the air-fuel ratio correction factor in the steady state. Next, a characteristic index calculation means 600 calculates characteristic indexes with respect to the respective control constants by use of the air-fuel ratio correction factor subjected to the steady-state learning.

Then, a control constant correction means 700 executes correction processing on the control constants by making reference to the characteristic indexes.

Here, the characteristic indexes with respect to the control constants are defined as the values of ai/a4, ci/c4 etc., as shown in FIGS. 10 and 12, and obtained through division between the elements of the air-fuel ratio correction factor $\alpha$ subjected to the learning. Further, at this time, since the air-fuel ratio correction factor $\alpha$ has a value near 1.0, the above processing can be carried out through subtraction in place of division.

Next, the foregoing processing will be described more in detail by use of flowcharts.

Figure 16:
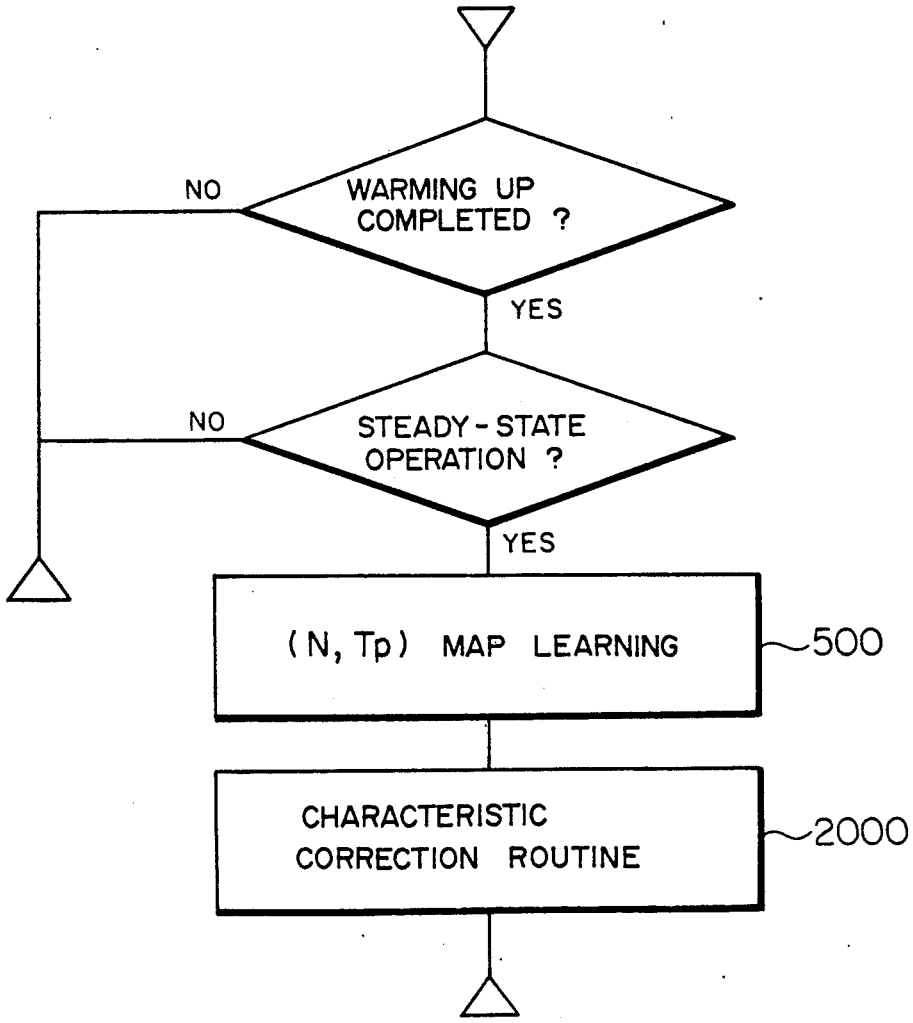
FIG. 16 is a brief flowchart of a characteristic correction routine.
Figure 17:
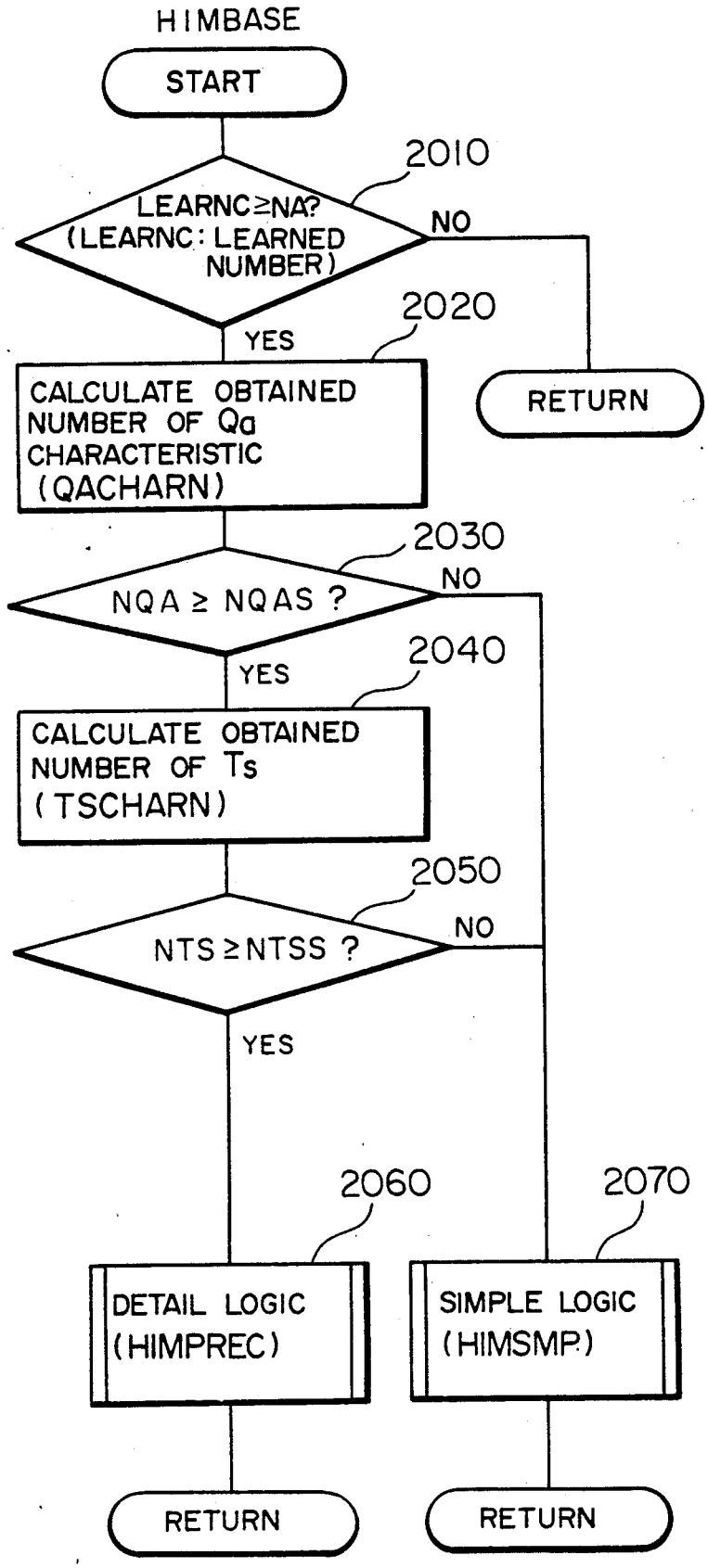
FIG. 17 is a flowchart of a correction logic.

FIG. 16 is a brief flowchart for executing a characteristic correction routine 2000 after the steady-state learning step 500 (executed by the steady-state learning means 500 in FIG. 15). FIG. 17 is a brief flowchart of this characteristic correction routine HIMBASE. In FIG. 17, first, judgement is made as to whether the number of learning is equal to or larger than a predetermined value NA in the step 2010. Then, the processing is shifted to the step 2020 if the answer is "Yes" in the step 2010, while the characteristic correction processing is not carried out if the answer is "No".

From the step 2020 to the step 2050, determination is made as to which one of a detailed logic 2060 and a simple logic 2070 is to be executed That is, the detailed logic 2060 is executed only in the case where the judgement proves that the number of obtained values of the $Q_a$ characteristic NQA is larger than a predetermined value NQAS and the number of obtained values of the $T_s$ characteristic NTS is larger than a predetermined value NTSS, while the simple logic 2070 is executed in the other case.

Figure 18:
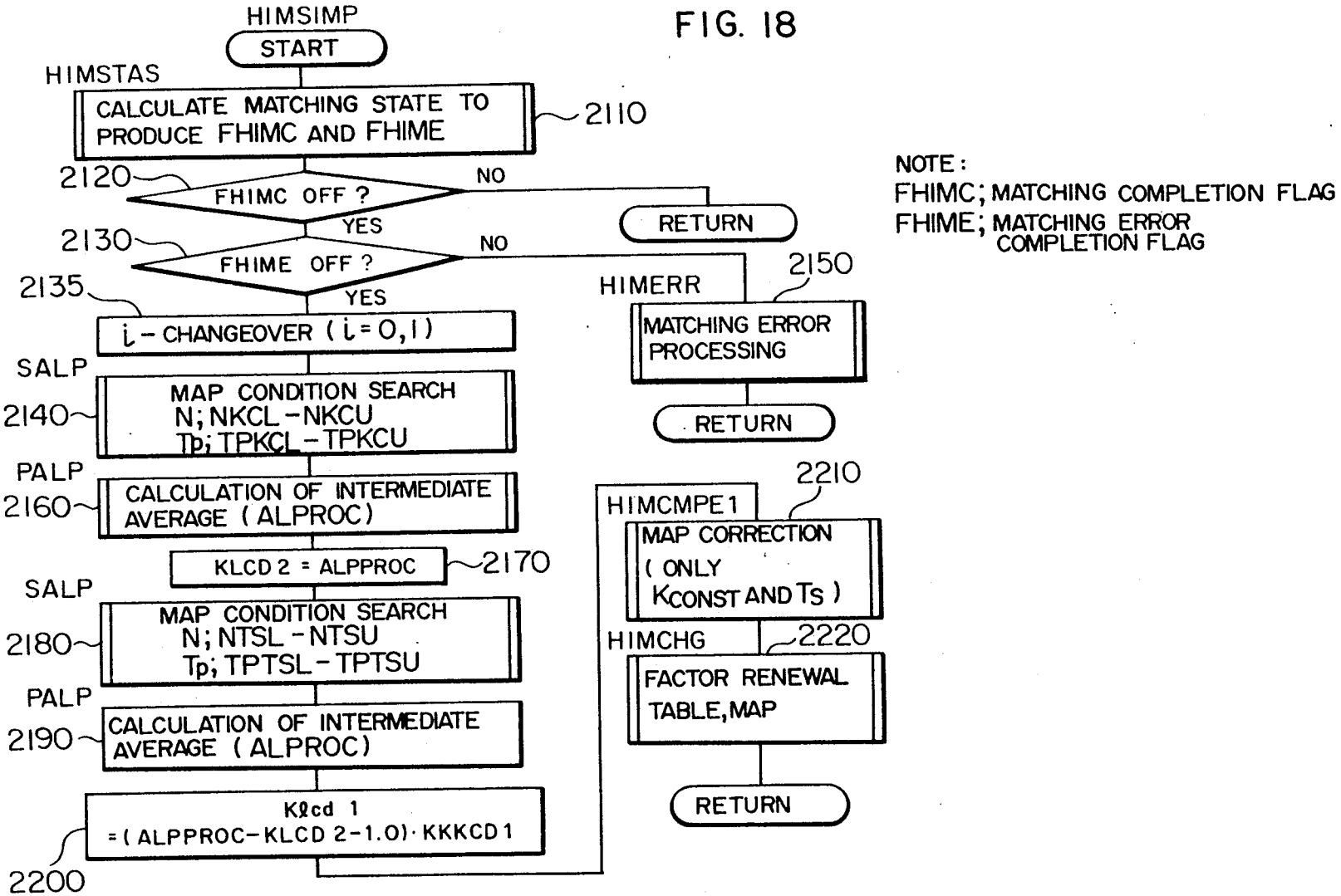
FIG. 18 is a flowchart of a simple logic.

FIG. 18 is a flowchart showing the processing contents of the simple logic HIMSIMP. In executing this logic, first, a matching state flag operation step 2110 is performed. In this step, it is determined that the matching or correction processing has been completed when the amount of change in values of the learning map obtained in the steady-state learning relative to the proceding values falls within a predetermined range, while it is determined that there is a matching error or correction error when the amount of change exceeds a given limit. In either case, either one of flags FHIMC and FHIME is set correspondingly.

In the steps 2120 and 2130, judgement is made as to whether those flags FHIMC and FHIME are set respectively. In either step, if the judgement proves that the matching has been completed, the processing is ended here so as to be shifted to return. After returning upon completion of matching, the operation is actuated so as to execute another task with a predetermined considerably long period so that the matching processing is executed periodically. Upon occurrence of a matching error, on the other hand, the matching error processing step 2150 is executed. In this embodiment, as the contents of the matching error processing step 2150, the correction processing is basically released and only the control is executed on the air-fuel ratio correction factor by the steady state learning.

In the case where the judgement proves that the matching has not been completed and no error has been generated, that is, the answer is "Yes" in the step 2130, the processing in the steps 2135 et seq is executed.

In the step 2135, the i-changeover processing is executed. The contents are as follows. That is, in this embodiment, there are two systems of maps, one being used as a present used map, the other being used as a calculation map. In this step 2135, the map change-over is executed in accordance with the conditions $i=1$ or $i=0$.

In the next step 2140, the map values necessary for $K_{const}$ correction in the region where $T_p$ is large is searched. This is because, in the region where $T_p$ is large, the influence of $T_s$ is little and the influence of $K_{const}$ controls the whole under the condition that the variation in the $Q_a$ characteristic is less.

Next, the step 2140 for intermediate average processing of the air-fuel ratio control constant $\alpha$ is executed. In this step, the maximum and minimum values are removed from the map values $\alpha$ extracted in the step 2140 and the remainder values are averaged. In the case where the number of the extracted values is 2 (two), the average of the two values is produced as the intermediate average value ALPROC, while in the case where only one value has been extracted, the extracted value is produced as it is as the intermediate average value ALPRO.

In the step 2170, the average value ALPRO is substituted into the $K_{const}$ correction value KLCD2.

In the succeeding map condition search processing step 2180, the map value $K_l$ is searched in the region where the value of $T_p$ in the map is small, and the intermediate average processing is executed in the step 2190 similarly to the above case.

In the succeeding step 2200, the $T_s$ correction value K1cd1 is calculated through multiplication by the gain KKKCD.

Subsequently the foregoing calculation, the learning map related to $K_{const}$ and $T_s$ is corrected in the map correction processing step 2210, and upon completion of map correction, the map is changed over in the step 2220 so that control can be performed with new factors.

The foregoing are the contents of the characteristic correction processing by the simple logic HIMSIMP.

Figure 19:
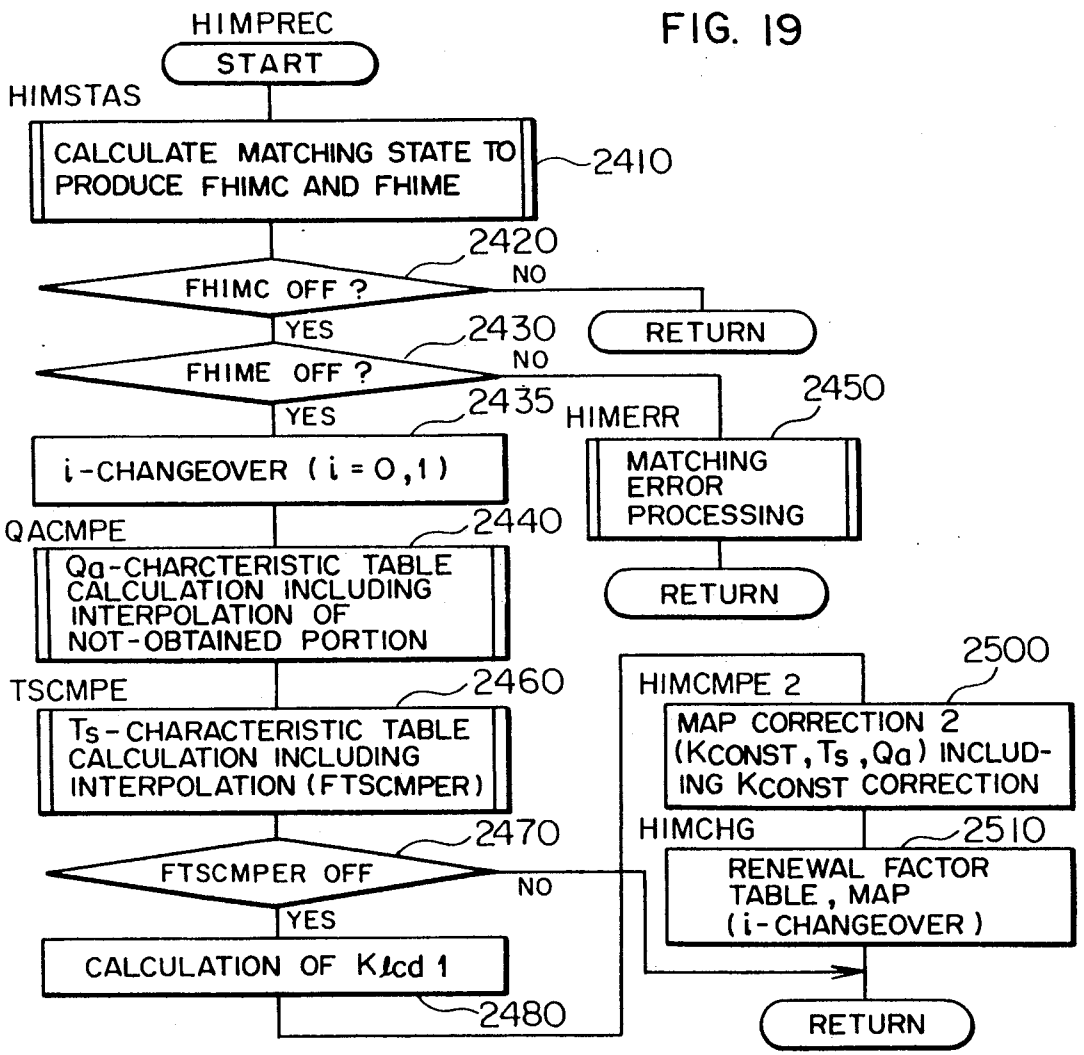
FIG. 19 is a flowchart of a detailed logic.

Next, referring to FIG. 19, the detailed logic HIMPREC will be described. In the flowchart of FIG. 19, the correction processing in the unmatched condition of all the $Q_a$, $K_{const}$, and $T_s$ will be described.

In the steps 2410, 2420, 2430, 2435 and 2450, the processing of matching completion and error judgement is executed in the same manner as in the case of the simple logic.

In the $Q_a$ characteristic table calculation processing step 2440, the characteristic indexes related to $Q_a$ are calculated. In this step, when only part of the characteristic indexes are calculated, the remainder is calculated by interpolation calculation so that all the characteristic indexes are calculated. Even in the case where the learning has not been entirely completed, the correction processing in this step can be executed by the interpolation processing.

In the succeeding $T_s$ characteristic table calculation processing 2460, the characteristic indexes related to $T_s$ are calculated in the same manner as in the step 2440. The $T_s$ characteristic indexes present a monotonous characteristic as explained with respect to FIG. 11. Accordingly, in the case where the result of calculation does not present such a monotonous characteristic, it is judged that there is an error and the error flag FTSCMPER is set. Thus, when an error exists, the processing in the judgement step 2470 is ended.

In the case where no error exists, the $T_s$ correction value K1cd1 is calculated in the succeeding step 2480.

In the succeeding map correction processing step 2500, the learning map is corrected with $Q_a$, $K_{const}$, and $T_s$. Upon completion of the learning map correction, the map is changed over in the same manner as in the foregoing case so as to make the engine control with new correction values.

The foregoing is the explanation for the detailed logic HIMPREC.

The relation between the control constants and the correction values may be summarized as follows.

(1) Control Constants (a) Injector (scalar values)

$K_{const}$:injector factor $T_s$:injector ineffective fuel injection time (b) Intake air flow rate sensor (linear table)

$Q_a(i)$:air flow rate characteristic (2) Correction Values

K1cd2:injector factor correction value $K_{const}$:$K_{consto} \times$ K1cd2

K1cd1:ineffective fuel injection time correction value $T_s = T_{so} + K1cd1$ $K1cd3(i)$ = air flow rate characteristic correction value $Q_a(i) = Q_{ao}(i) \times K1cd3(i)$ Here, $K_{consto}$, $T_{so}$ and $Q_{ao}(i)$ are initial reference values.

The foregoing correction for various control constants requires a two-dimensional map of air-fuel ratio correction factor for the engine speed and load. On the other hand, here, description will be made hereunder about correction for various control constants taking a serious view of efficiency of use of memories, that is, correction for various control constants which can be realized with a small number of memories.

As shown in FIG. 15, an air-fuel ratio correction factor generated in the air-fuel ratio feedback means 400 is stored in the steady-state learning means 500. The way of storing the air-fuel ratio correction factor varies depending on the condition of correction.

Figure 20:
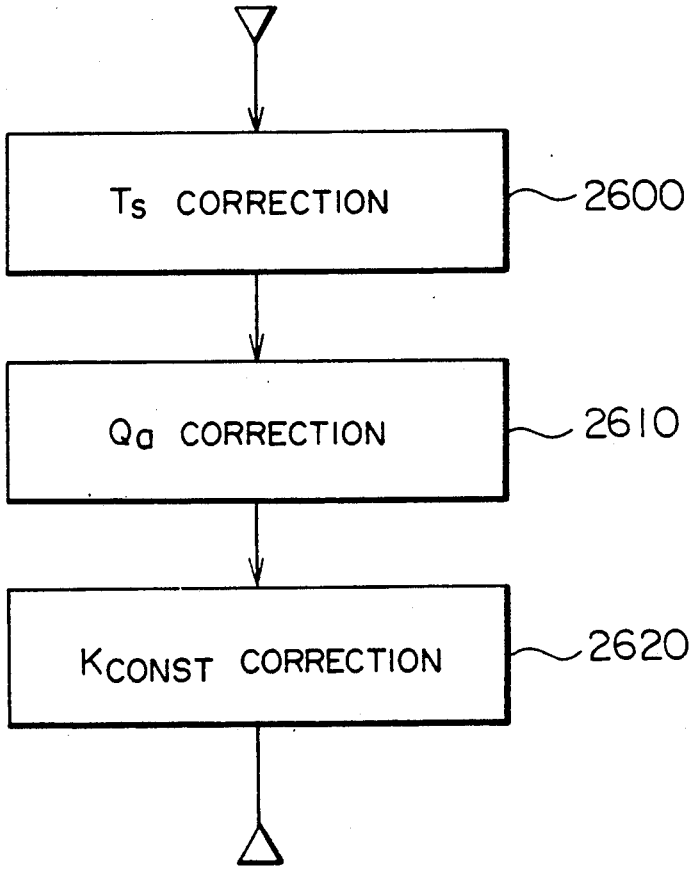
FIG. 20 is a block diagram showing another method for memory correction.

By way of the values stored in the steady-state learning means 500, cteristic indexes are calculated in the characteristic index calculation means 600 and the control constants are corrected in the control constant correction means 700. To realize the correction with a small number of memories, the various control constants are subjected to sequential correction. FIG. 20 shows the order of the sequential correction.

The $T_s$ (ineffective fuel injection time) correction step 2600 is first executed, and then the $Q_a$ (air flow rate) correction step 2610 and the $K_{const}$ correction step 2620 are executed sequentially.

Figure 21:
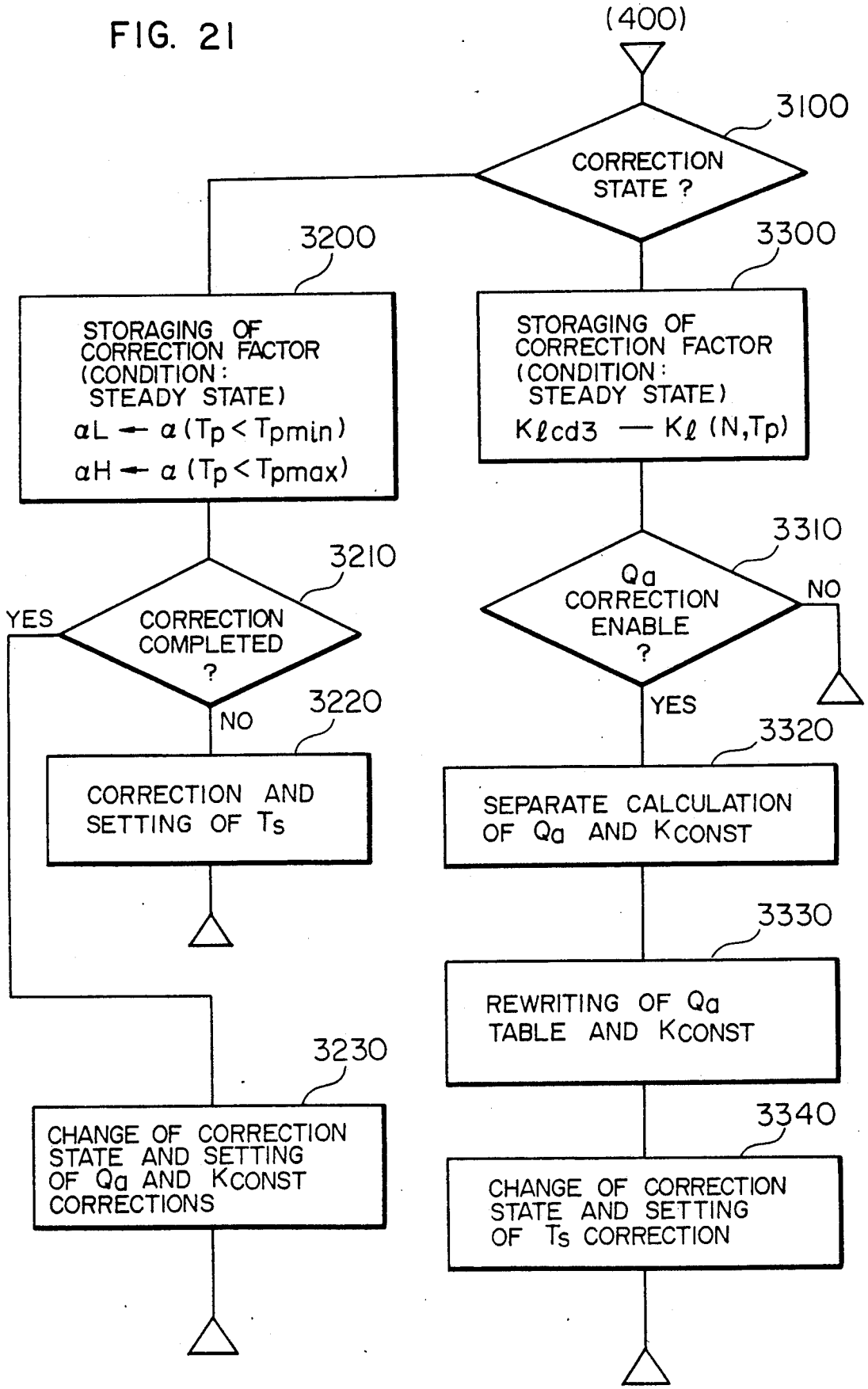
FIG. 21 is a control flowchart for the method of FIG. 20.

FIG. 21 is a flowchart for executing the control constant correction processing. After the feedback control 400, the correction state judgement step 3100 is executed and then the $T_s$ correction step 3200 is executed. Upon completion of the $T_s$ correction in the step 3210, the $Q_a/K_{const}$ correction step 3300 is executed. Upon completion of the $Q_a/K_{const}$ correction in the step 3330, the $T_s$ correction step 3340 is executed. Then, the operation is returned to the processing step 3200 again.

In the processing step 3200, the value of air-fuel ratio correction factor $\alpha$ produced by feedback control is stored as a value necessary for the $T_s$ correction. The processing is carried out when the operating condition is steady. That is, this processing is executed when the deviations in engine speed and load fall within a predetermined region. In storing, the value of the air-fuel ratio correction factor $\alpha$ is stored as a value $\alpha_L$ when the load reflecting the matched value of $T_s$, that is, the fundamental fuel injection time $T_p$ in this example, has a value smaller than $T_{pmax}$, while stored as a value $\alpha_H$ when the value of the fundamental fuel injection time $T_p$ is larger than $T_{pmax}$. The value $\alpha_H$ in the case of a high load ($T_p > T_{pmax}$) is a representative value of $\alpha$ which is less influenced by $T_s$.

Next, the following calculation is performed.

$$\Delta\alpha = \alpha_L \alpha_H \quad (34)$$

This is a calculation performed in place of division of $\alpha_L/\alpha_H$, and $\Delta\alpha$ is an index for checking the influence due to unmatched value of $T_s$. That is, in the case where $T_s$ is in the matched condition, the relation $\Delta\alpha = 0$ is established, while if the setting of $T_s$ is larger than a new value the relation $\Delta\alpha < 0$ is established.

Then, in the next judgement processing step 3210, if the result proves that the $T_s$ correction has been completed on the basis of the fact that the value of $\Delta\alpha$ falls within a predetermined range to satisfy the relation $|\Delta\alpha| < \epsilon'$, the next $Q_a/K_{const}$ correction is set in the step 3230. If the judgement in the step 3210 proves that the $T_s$ correction has not been completed, the correction and setting of $T_s$ is performed in accordance with the following equation by use of the value of $\Delta\alpha$ obtained by the equation (34).

$$T_s = T_{sold} + K1cd1 \times \Delta\alpha$$

The processing is repeated to make the value of $T_s$ proper.

Next, the $Q_a/K_{const}$ correction step 3300 will be described. Similarly to the step 3200, the value of air-fuel ratio correction factor $\alpha$ produced by feedback control in the steady state is stored first. Considering now the correction of the air flow rate $Q_a$, the value of air-fuel ratio correction factor $\alpha$ is stored in accordance with the degree of the air flow rate $Q_a$.

Figure 22:
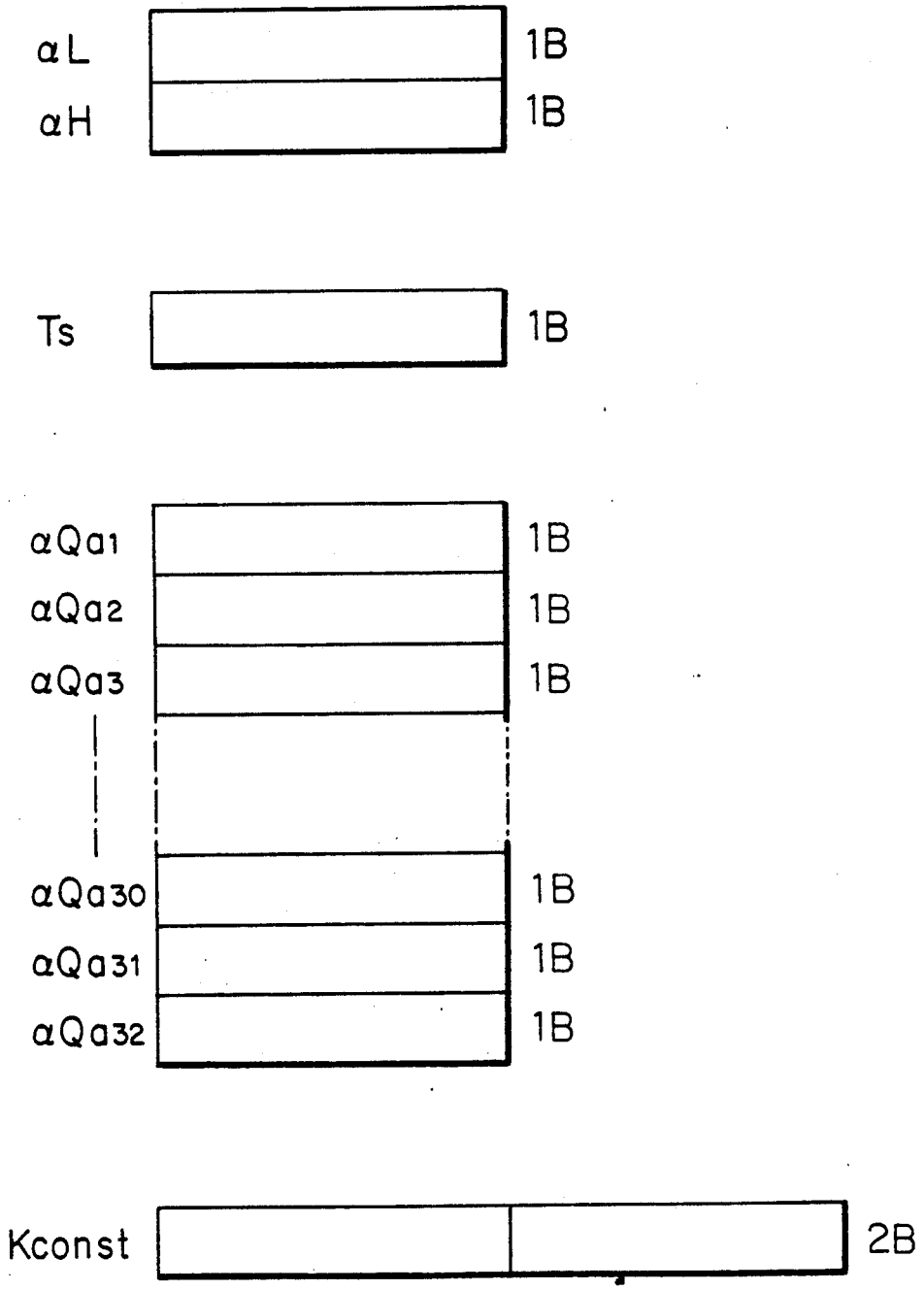
FIG. 22 is a view showing the memory contents.

FIG. 22 shows an example of a memory map in which 32 divisional areas $Q_{a1}$–$Q_{a32}$ are prepared. In the step 3310, judgement is made as to whether a necessary number of values for performing correction have been obtained or not. If the answer in the step 3310 is "Yes", that is, in the case where $Q_a$ correction can be made, the processing is shifted to the step 3320. If the answer in the step 3310 is "No", that is, in the case where $Q_a$ correction cannot be made, on the contrary, the processing is ended. In the step 3320, separate $Q_a/K_{const}$ calculation is executed. That is, here, an average value $\alpha_{AVE}$ of $\alpha(Qj)$ which are m in number is obtained here.

$$\alpha_{AVE} = 1/m \Sigma \alpha(Qj)$$

By use of this value of $\alpha_{AVE}$, the value of $K_{const}$ is corrected as shown in the following equation (35).

$$K_{const} = K_{const \cdot OLD} \times \alpha_{AVE} \quad (35)$$

This processing means that the bias component of $\alpha$ is corrected with $K_{const}$. In the value of $K_{const}$, an unmatched component of $K_{const}$ and a uniform error of $Q_a$ are contained. However, these unmatched component and uniform error can be compensated for in the calculation of $T_p$.

Next, in the case where the values of $\alpha$ have been obtained in the necessary number but not entirely, it is necessary to perform a presumption operation with respect to not-obtained portion of the values of $\alpha$. In the case where there are values of $\alpha$ before and after the not-obtained portion, the average value $\alpha_{AVE}$ is obtained through proportional distribution, and in the case of extrapolation, the average value $\alpha_{AVE}$ is made to be 1.0. After completion of the foregoing processing, a correction $Q_{va}$ table is formed.

Upon completion of the foregoing, control is initiated with the $Q_a$ characteristic and $K_{const}$ in the step 3340.

The foregoing is the flow of processing. A memory necessary for the foregoing processing is shown in FIG. 22. Since the correction in the axial direction is performed basically, it is possible to realize the foregoing correction with a small number of memories.

The foregoing embodiment of the present invention has an effect that the number of times of multiplication is small in the calculation of the final fuel injection time so that correction processing can be carried out rapidly because the control constants are arranged properly.

As described above, according to the present invention, the various control constants can be rationalized automatically in a short time.

Since the control constants are rationalized, the calculation of the fundamental fuel injection time is rationalized and therefore the setting of the ignition timing which is determined by the fundamental fuel injection time is also rationalized, thereby making it possible to realize proper engine control collectively.

Figure 23:
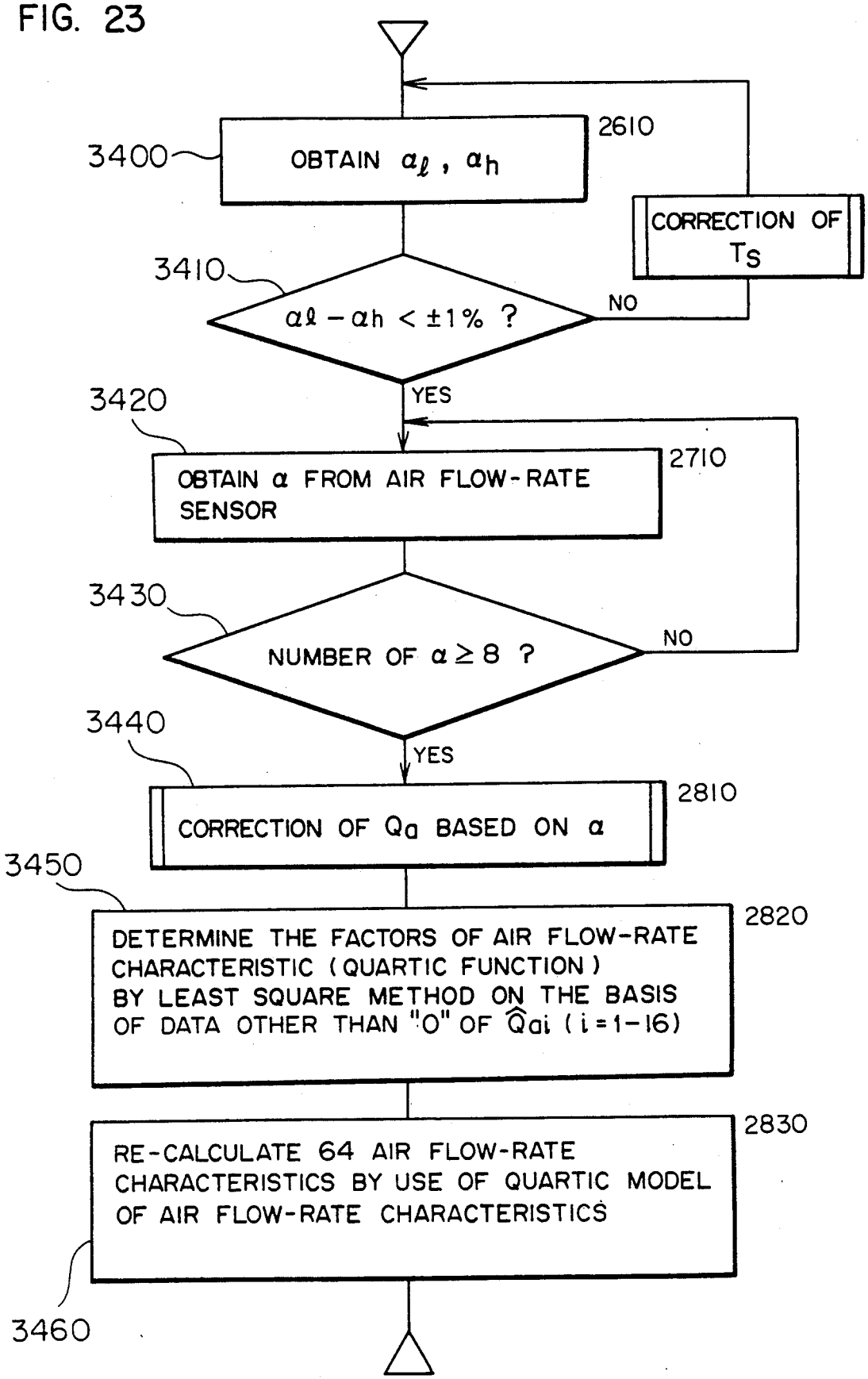
FIG. 23 is a flowchart for correcting the entire region.

In the foregoing, the rationalization of the control constants under the condition where $O_2$ feedback is carried out has been described. The rationalization in condition other than the foregoing will be described hereunder by referring to FIG. 23.

First, the correction on $T_s$ is described. $T_{pl}=1.5$ msec and $T_{ph}=3.0$ msec in which the air flow rate sensor produces the same output are found and the values of $\alpha$ at that time are represented by $\alpha_l$ and $\alpha_h$ respectively, in the step 3400. If there occurs any error between the values $\alpha_l$ and $\alpha_h$ which are to be the same value of $\alpha$ because they are on the same iso $Q_a$ line as seen in FIG. 9, the error that is caused by the unmatching of $T_s$. It is possible to correct the unmatched value of $T_s$ by use of this error.

The correction of $T_s$ is performed in accordance with the following equation (36).

$$\begin{aligned} T_s &= T_s + KDTS \times (\alpha_l - \alpha_h) \\ &= T_s + KDTS \times (\Delta T_s/T_{pl} - \Delta T_s/T_{ph}) \end{aligned} \quad (36)$$

where the correction gain KDTS is as follows.

$$\begin{aligned} KDTS &= \frac{(T_s^* - T_s)}{(T_s/T_{pl} - T_s/T_{ph})} \\ &= (T_{pl} \times T_{ph})/(T_{pl} - T_{ph}) \end{aligned}$$

where $T_s^*$ is obtained by the equation (36).

Since $T_{pl}=1.5$ msec and $T_{ph}=3.0$ msec in this example, KDTS=3. By substituting this value of KDTS in the equation (36), the $T_s$ correction is carried out.

When this correction becomes $\pm 1\%$, the judgement in the step 3410 proves that the $T_s$ correction has been completed. In order to start the $Q_a$ table correction, the range of from 1.04 V to 3.44 V of the output voltage of the air flow rate sensor is divided into 16 regions at regular intervals of 160 mV and various values of $\alpha$ in the divisional regions are stored in the step 3420. Next, judgement is made as to whether eight or more values of $\alpha$ have been obtained or not in the step 3430, and when the answer of the judgement is "Yes", the $Q_a$ correction is initiated in the step 3440. That is, the values of $Q_a$ in the regions corresponding to the respective 8 or more values of $\alpha$ are corrected so as to obtain the correction term $Q_{ai}$ (i=1, 2, . . . ). The coefficients of an air flow rate characteristic expression (corresponding to a quartic function) are determined in the step 3450 on the basis of the correction term $Q_{ai}$ through a method of least squares.

The air flow rate characteristic expression (corresponding to a quartic function) is such that the output voltage $Q_aV$ of the air flow rate sensor is approximated to a quartic function of the air flow rate $Q_a$. That is, the air flow rate characteristic expression (corresponding to a quartic function) is as follows.

$$Q_aV = a0 + a1Q_a + a2Q_a2 + a3Q_a3 + a4Q_a4$$

Accordingly, the coefficients aj (j=0, . . . , 4) are determined by use of the correction term $Q_{ai}$ through a method of least squares.

The values of the air flow rate are calculated again over the whole regions of the $Q_a$ table by use of the above air flow rate characteristic expression so as to renew the calculation values in the step 3460.

Thus, it is possible to renew the $Q_a$ table over the whole regions thereof.

Next, an abnormality detection method utilizing the present invention will be described.

Figure 24:
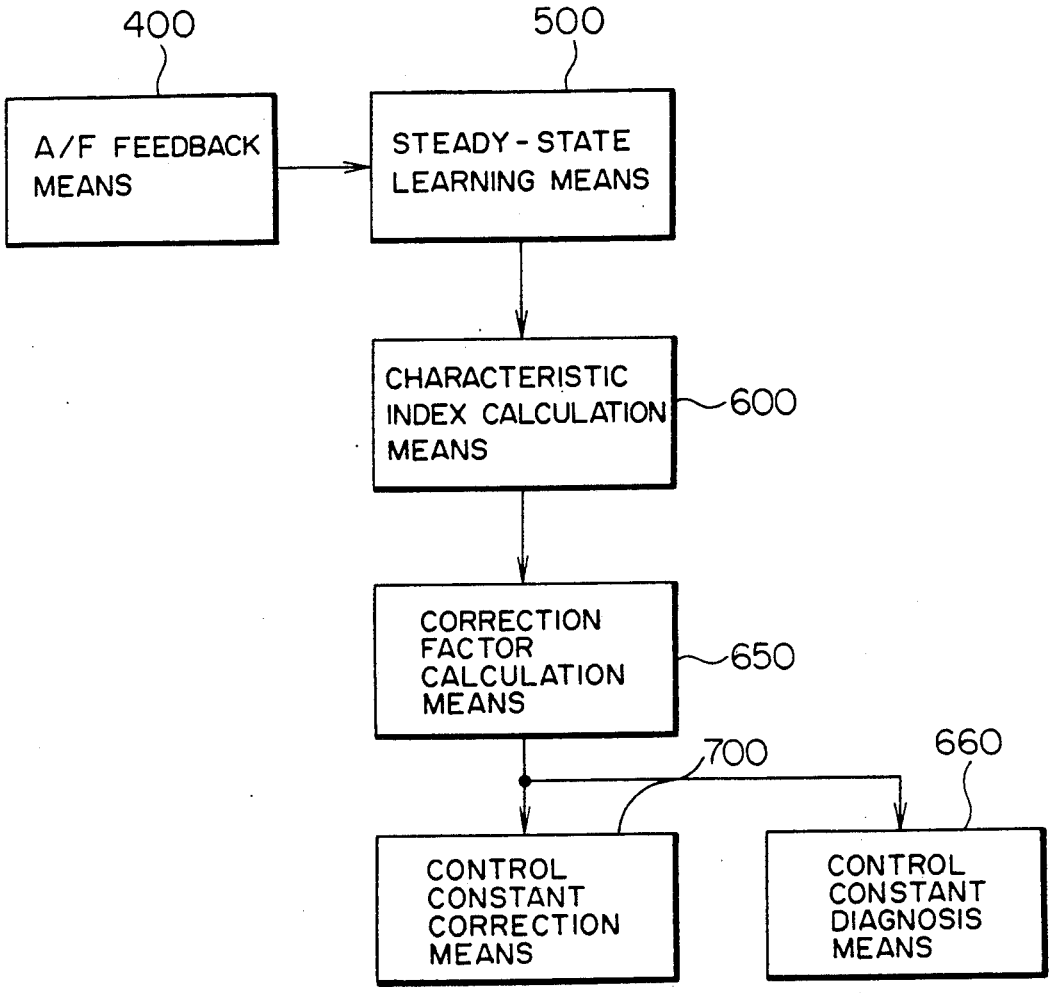
FIG. 24 is a block diagram showing the operation function for abnormal detection.

FIG. 24 is a block diagram showing an embodiment of the present invention. Being basically similar to the configuration of FIG. 15, this embodiment has a feature in that not only the above-mentioned various correction factors K1cd1, K1cd2 and K1cd3 calculated in a correction factor calculation means 650 are corrected in a control constant correction means 700, but there is provided a control constant diagnosis means 660 for performing diagnosis on the control constants by using those correction factors K1cd1, K1cd2 and K1cd3.

Figure 25:
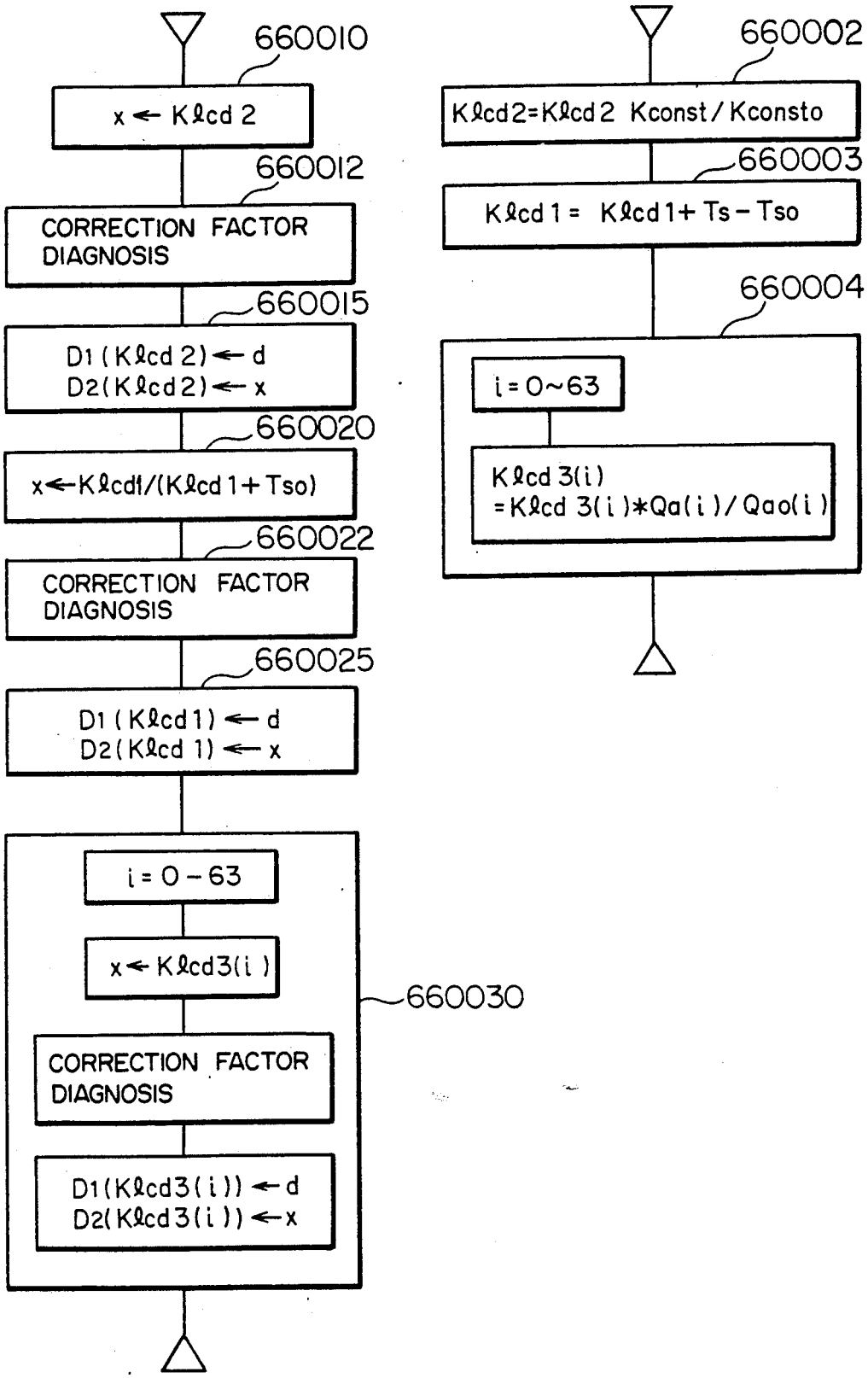
FIG. 25 is a flowchart for diagnosis processing.

FIG. 25 is a flowchart showing an embodiment of the processing in the control constant diagnosis means 660. First, the processing steps 660002–660004 are executed to calculate the correction factors K1cd1, K1cd2 and K1cd3.

Figure 26:
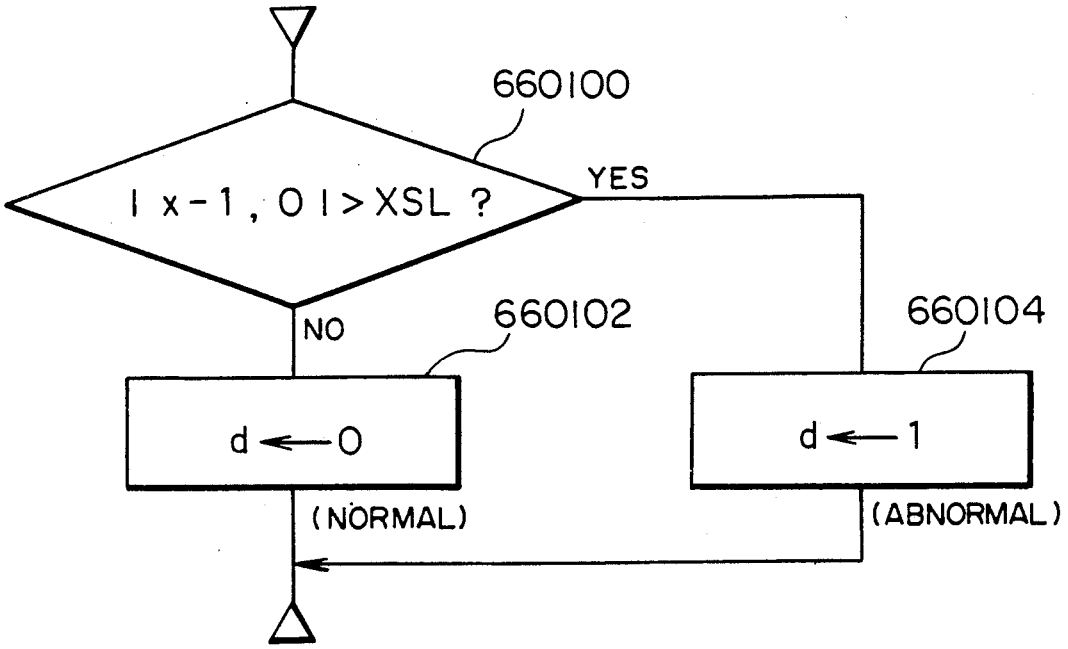
FIGS. 26 to 29 are flowcharts for judgement processing under judging conditions different from each other.

Next, in order to perform diagnosis on $K_{const}$, K1cd2 is substituted into x in the step 660010. Then, the processing is shifted to the next processing step 660012. FIG. 26 shows the detail of the processing in the step 660012. In this processing, judgement is made in the step 660100 as to whether or not the absolute value of the deviation from 0.1 of a presently given value of x exceeds a predetermined value XSL (for example, 60%). If the answer of the judgement in the step 660100 is "Yes" or "No", the data d indicating the result of diagnosis is set to "1" or "0" to indicate the presence or absence of abnormality in the processing step 660102 or 660104 respectively, thus completing the diagnosis.

After completion of the diagnosis on the correction factor $K_{const}$ in the processing step 660012, the result of diagnosis is stored in the diagnosis result RAM memory-table at $D_1$(K1cd2) and $D_2$(K1cd2) which are flag bits indicating the existence of abnormality and the correction factor respectively. With respect to the flag bit D1(K1cd2), the value of K1cd2 may be used as it is.

The next diagnosis processing relates to the correction factor $T_s$. With respect to this $T_s$, since the value of K1cd1 does not have relative magnification, the value x is obtained through the calculation shown in the processing step 660020. The contents of processing in the steps 660022 and 660025 are the same as that in the foregoing processing of the correction factor $K_{const}$ in the steps 660012 and 660015.

Finally, the diagnosis processing on the $Q_a$ table is executed in the step 660030.

In this embodiment, as seen in the illustrated contents of the processing step 660030, diagnosis is carried out on all the 64 table values and a diagnosis table is formed for every table value. Alternatively, synthetic evaluation may be made over the whole of the 64 table values (for example, in the case where the sum of $\Sigma$ of $|x-1.0|$ exceeds a predetermined value) so as to form representative parameters $D_1$ and $D_2$.

Figure 27:
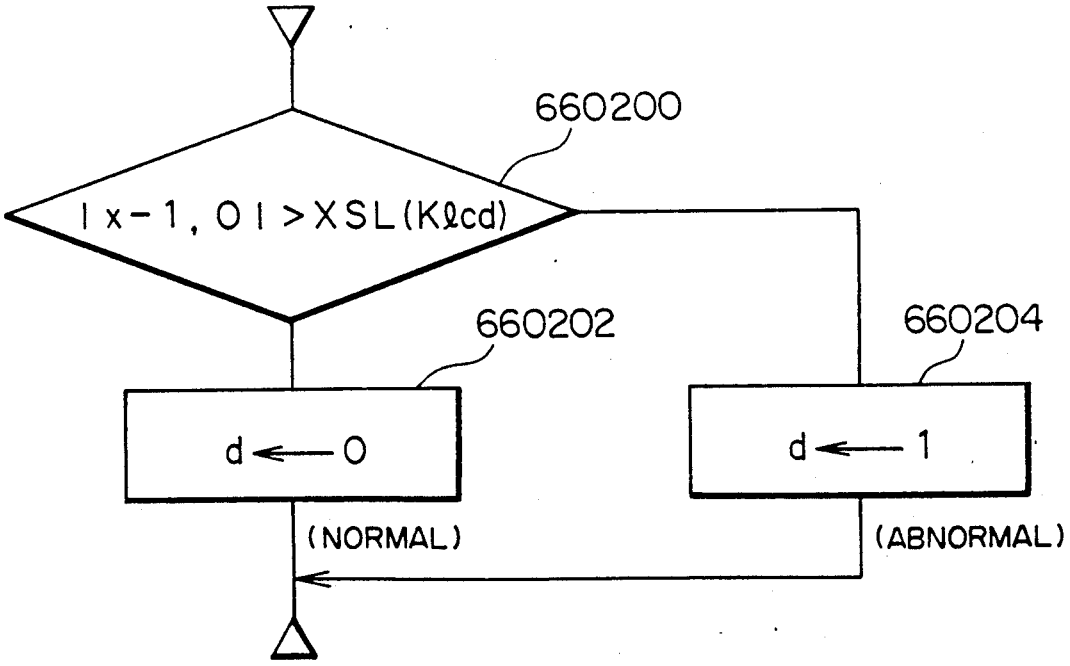

FIG. 27 shows another embodiment of this diagnosis. Based on the consideration that it is effective to vary the predetermined value XSL for evaluation depending on the kind of the control constants, for example $K_{const}$ and $P_s$, the processing contents in the steps 660200, 660202 and 660204 are set correspondingly.

It is defined that the foregoing control constant diagnosis processing is actuated upon renewal of various control parameters.

According to this embodiment, therefore, diagnosis on the sensors and actuators in operation can be readily executed only by comparing the correction factors with respective predetermined values and occurrence of abnormality can be found in the early stage, so that high reliability can be attained.

Figure 28:
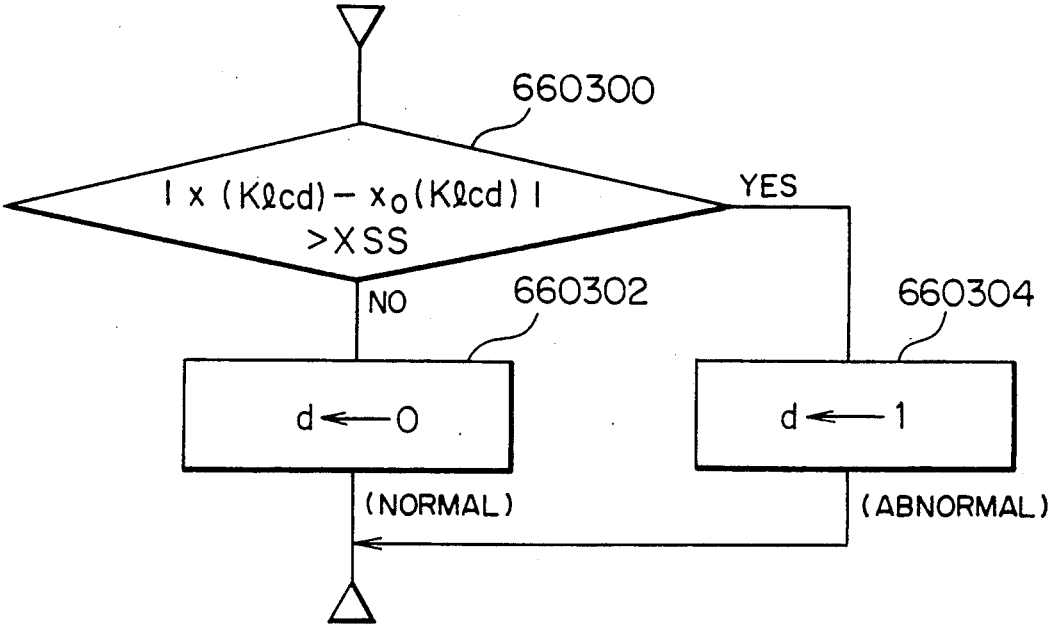

FIG. 28 shows another embodiment of the diagnosis processing.

In this embodiment, in the judgement processing step 660300, the numerical value $x_o$(K1cd) represents the correction factor upon shipping the engine or immediately after the adjustment of the sam e, and the diagnosis is performed on the basis of an absolute value of a difference between this numerical value $x_o$(K1cd) and the value of a present correction factor x(K1cd). The processing in the other steps 660302 and 660403 are the same as those in the embodiment of FIG. 27.

According to this embodiment, the characteristic peculiar to the equipment upon shipping is provided as a primary evaluation value $x_o$(K1cd) and the diagnosis is performed on the basis of a difference between the primary evaluation value and an evaluation value obtained in the succeeding diagnosis, so that the judgement error due to variations in equipment characteristic can be suppressed.

Figure 29:
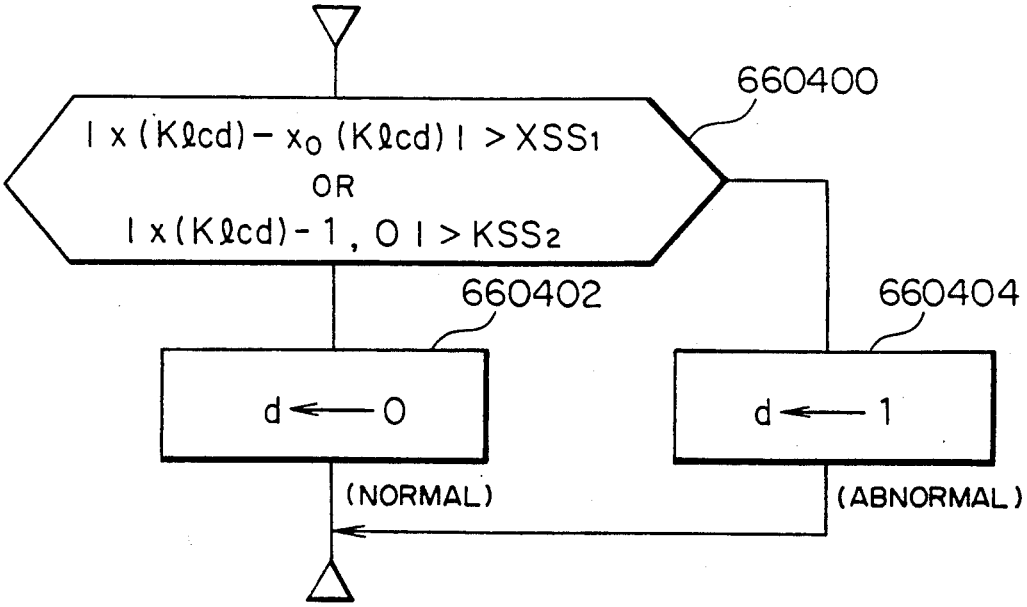

FIG. 29 shows a further embodiment of the diagnosis processing. In the judgement processing step 660400 in this embodiment, the judgement by means of a difference like in the embodiment of FIG. 28 as well as a deviation from a reference are used as parameters for evaluation.

According to this embodiment, therefore, both a deviation from an initial value and a deviation from a reference are referred to so that the objectivity with respective to the judgement is made high and correct diagnosis can be obtained.

Next, the various data storage conditions in the embodiments of the present invention will be described by referring to FIG. 30.

The control constants, $$K_{const0}, Q_{a0}(0)—Q_{a0}(63),$$

are stored in ROM, and the control constants, $$K1cd1, K1cd2, K1cd3(0)-K1cd3(63),$$

which are to be used in the control constant correction means are the correction factors for the present control parameters $$K_{const}, T_s, Q_a(0)-Q_a(63),$$

and are used on RAM.

The correction factors for the initial correction control constants $$K_{const0}, Q_{a0}(0)-Q_{a0}(63)$$

are already-corrected K1cd1, K1cd2, K1cd3(0)−K1cd3(63) and used on RAM.

Figure 31:
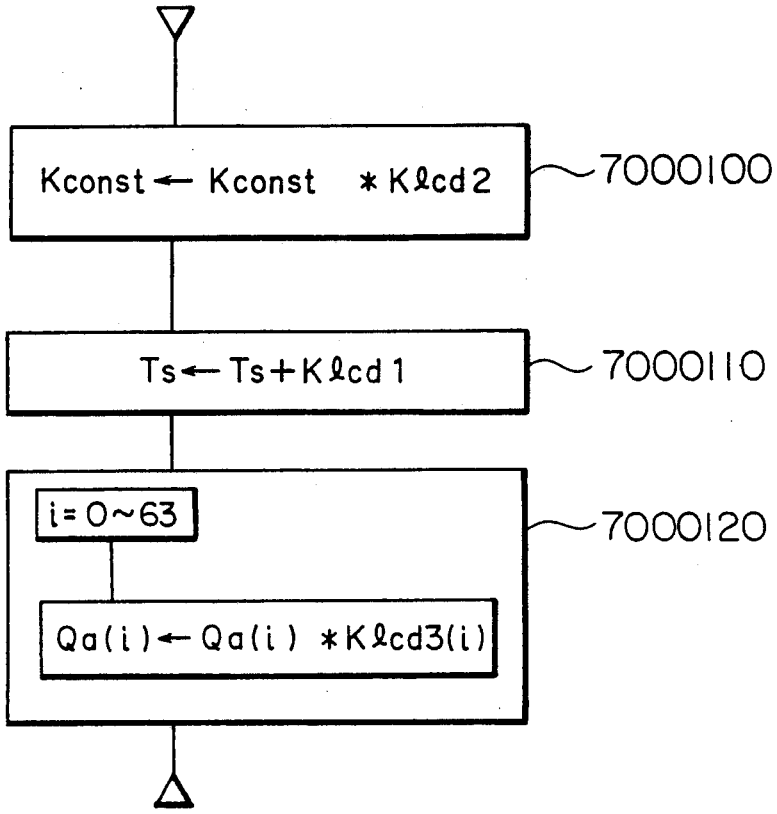
FIG. 31 is a flowchart for control constant calculation.

FIG. 31 shows another embodiment of the control constant setting processing in which correction processing is executed when control parameters are changed.

In this embodiment, processing on $K_{const}$ is carried out in the step 7000100, processing on $T_s$ is carried out in the step 7000110, and processing with respect to $Q_a$ is carried out in the step 7000120.

According to this embodiment, the correction operation is executed every time a control parameter is changed, so that it is not necessary to perform correction processing every time a control parameter is used.

Figure 32:
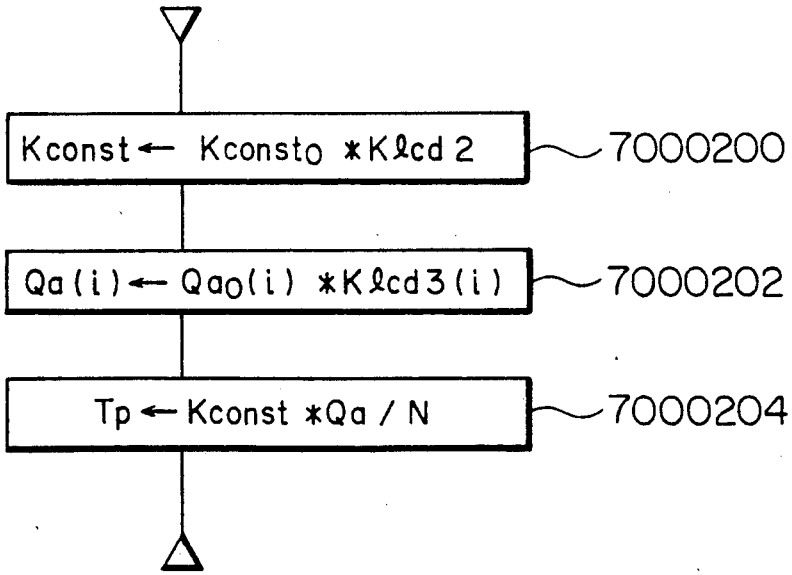
FIG. 32 is a flowchart showing another example of the control constant calculation.
Figure 33:
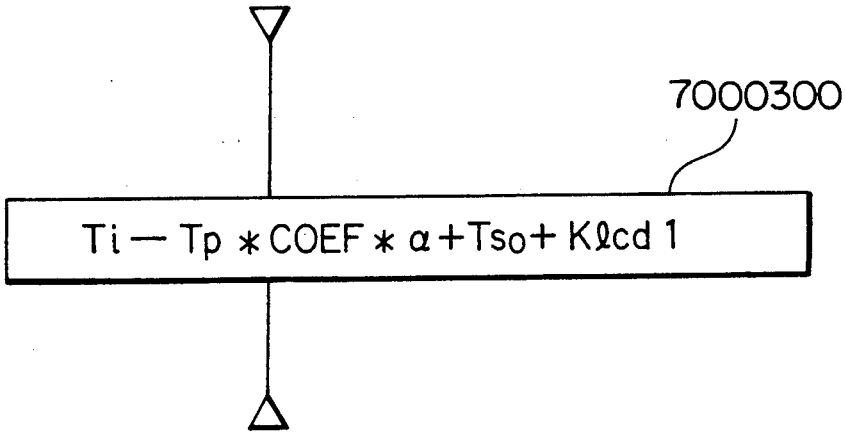
FIG. 33 is a flowchart showing still another example of the control constant calculation.

FIGS. 32 and 33 show further embodiments of the control constant setting processing in which correction processing is executed through processing steps 7000200–7000204 and 7000300 respectively, every time control parameters are used.

Figure 30:
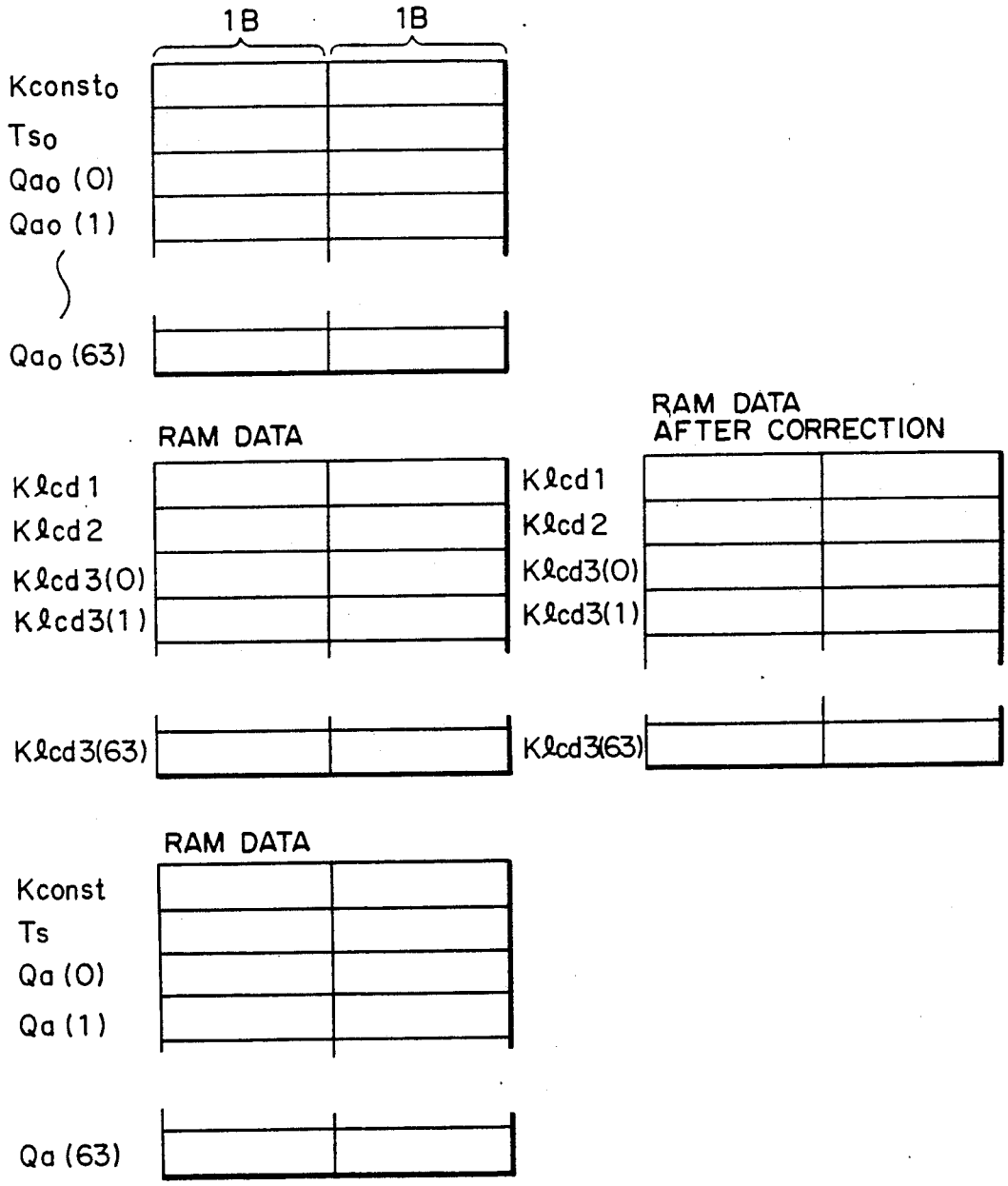
FIG. 30 is a block diagram for explaining the memory.

According to these embodiments, it is not necessary to hold the respective date of $$K_{const}, T_s, Q_a(0)-Q_a(63)$$

unlike the embodiment of FIG. 30, and therefore the capacity of the memory can be reduced.

Figure 34:
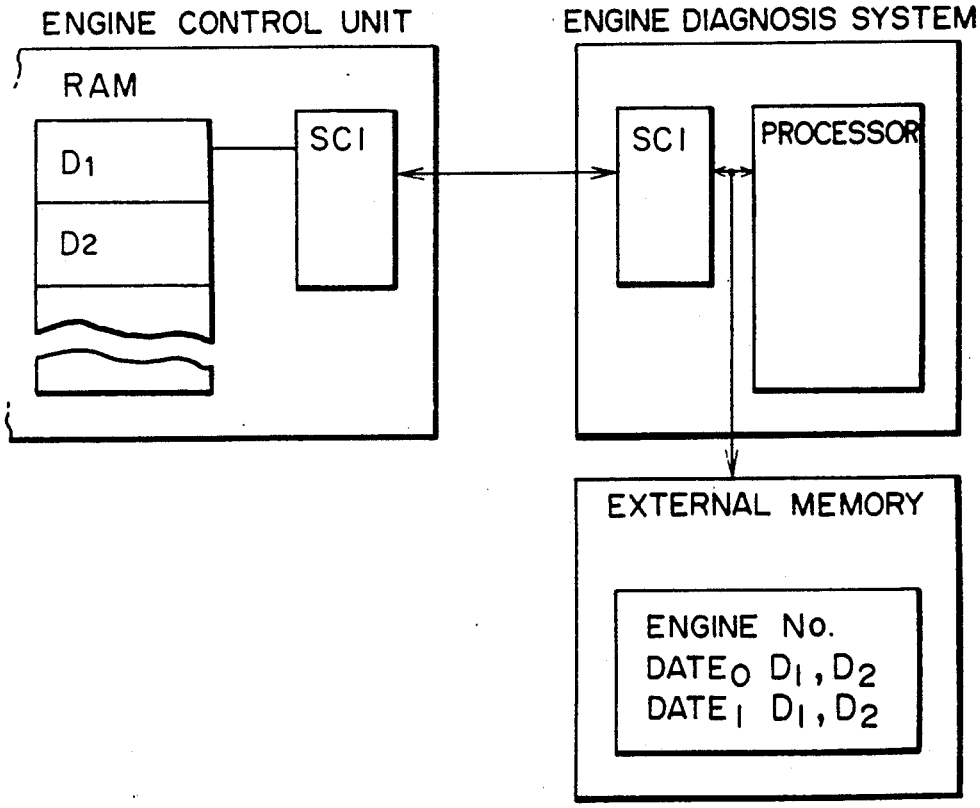
FIG. 34 is a view illustrating the configuration of another embodiment of the present invention.
Figure 35:
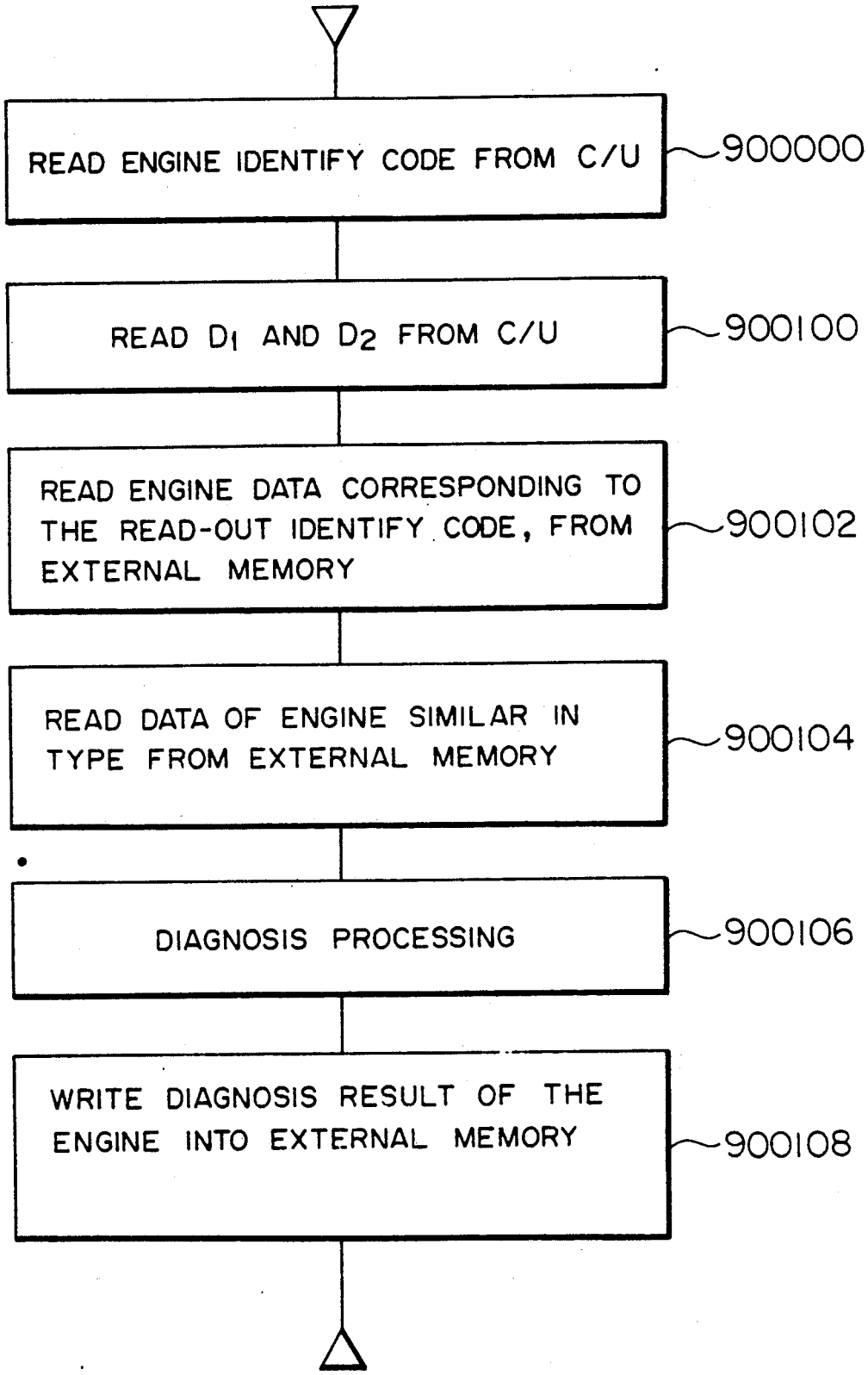
FIG. 35 is a flowchart for explaining the operation of the embodiment of FIG. 34.

FIG. 34 shows an embodiment in which diagnosis processing is externally carried out. In this embodiment, a serial communication port SCI is provided in each of an engine control unit and an external engine diagnosis system to make it possible to make an access between a processor in the engine diagnosis system and a RAM in the engine control unit so that data $D_1$ and $D_2$ stored in the RAM can be read from the processor. FIG. 35 shows the processing executed in this embodiment of FIG. 34.

In executing this processing, an engine identifying code previously assigned to the engine and the data $D_1$ and $D_2$ are read into the engine diagnosis system from the engine control unit (C/U) in the steps 900000 and 900100 respectively. Then, the data of history of the engine and the data of results of past diagnosis on another engine similar to the present engine are read into the engine diagnosis system from an external storage device in the steps 900102 and 900104 respectively. On the basis of those data, the diagnosis processing mainly including the same diagnosis processing as described above and the pattern matching of the foregoing history data with the data of diagnosis result is carried out in the step 900106 and the result of diagnosis is stored again in the step 900108.

In this embodiment, therefore, diagnosis can be carried out objectively and accurately because the data in the engine control unit (C/U) is transferred to the external engine diagnosis system so that diagnosis can be performed while referring to history data peculiar to the engine and examples of other engines. In this embodiment, alternatively, the result of diagnosis may be written in the memory in the engine control unit (C/U). In this embodiment, further alternatively, the control apparatus may be arranged such that the engine is driven so that diagnosis is performed while fetching data in operation on board.

Thus, according to the present invention, the characteristics of sensors and actuators provided in an engine control apparatus can be desiredly subjected to diagnosis, so that the operating conditions of the engine control apparatus can be always surely grasped, on-line gas control and self diagnosis can be performed, and rational car operating and maintenance can be attained easily.

We claim:

1. A car control apparatus, comprising:
(a) an operating condition detection means for detecting one of a plurality of operating condition parameters in an actuating system of a car;
(b) a regulation means for regulating the operating conditions of said actuating system of said car;
(c) a control signal generation means for generating a control signal for controlling said regulation means on the basis of an output of said operating condition detection means; and
(d) a correction means for obtaining a learning factor by feedback of said one car operating condition parameter, and for deriving at least two correction factors from said learning factor; said correction factors including a control constant correction factor for correcting a control constant component to be used for generating at least the control signal, and an output constant correction factor for correcting an output constant component of said operating condition detection means; and for correcting the control constant of said control signal and the output correction constant using said correction factors.

2. A car control apparatus, comprising:
(a) an operating condition detection means for detecting one of a plurality of operation condition parameters in an actuating system of a car;
(b) a regulation means for regulating the operating conditions of said actuating system of said car;
(c) a control signal generation means for generating a control signal for controlling said regulation means on the basis of an output of said operating condition detection means; and
(d) a correction means for obtaining a learning factor by feedback of said one car operating condition parameter, and for deriving at least two correction factors from said learning factor; said correction factors including a control constant correction factor for correcting an initial control constant component to be used for generating at least the control signal, and an output constant correction factor for correcting an initial output constant component of said operating condition detection means; and for correcting the initial control constant of said control signal and the initial output correction constant using said correction factors.

3. A car control apparatus, comprising:
(a) an operating condition detection means for detecting one of a plurality of operating conditions in an actuating system of a car;
(b) a regulation means for regulating the operating conditions of said actuating system of said car;
(c) a control signal generation means for generating a control signal for controlling said regulation means on the basis of an output of said operating condition detection means, said control signal generation means including a memory means; and
(d) initial constant setting means for obtaining a learning factor by feedback of said one car operating condition parameter, and for deriving at least two correction factors from said learning factor; said correction factors including a control constant correction factor for correcting an initial control constant component to be used for generating at least the control signal, and an output constant correction factor for correcting an initial output constant component of said operating condition detection means; and for correcting the initial control constant of said control signal and the initial output correction constant using said correction factors, said corrected initial control constant of said control signal and the initial output correction constant being stored in said memory means.

4. A method for controlling a car having a car control apparatus, comprising:
(a) an operating condition detection means for detecting one of a plurality of operating conditions in an actuating system of a car;
(b) a regulation means for controlling the operating conditions of said actuating system of said car; and
(c) a control signal generation means responsive to an output of said operating condition detection means for generating a control signal for controlling said regulation means and for generating control constants stored in a memory or correction constants to be used for correcting output characteristics of said operating condition detection means;
wherein said method in which said constants are renewed comprises the steps of:
(1) storing desired constants into said memory;
(2) producing said control signals by using said desired constants to thereby control said regulation means;
(3) feeding back one of a plurality of parameters of said car operating conditions to thereby obtain a learning factor of said actuating system;
(4) dividing said variation components into two or more correction factors including a control constant correction factor for correcting a control constant component to be used for generating at least the control signal, and an output constant correction factor for correcting an output constant component of said operating condition detection means, and correcting the control constant of said control signal and the output correction constant using said correction factors; and
(5) updating said constants which have been stored in said memory by using said correction factors.

5. A car control apparatus, comprising:
(a) an air-fuel ratio sensor for detecting an air-fuel ratio on the basis of exhaust gas components of an engine;
(b) an air flow sensor for detecting an amount of air sucked into said engine;
(c) an injection signal generation means for generating a fuel injection signal on the basis of an output of said air flow sensor; and
(d) a correction means for obtaining a learning factor on the basis of a signal of said air-fuel ratio sensor, and for deriving at least two correction factors from said learning factor; said correction factors including a control constant correction factor for correcting a control constant component to be used for generating at least the fuel injection signal, and an output constant correction factor for correcting an output constant component of said air flow sensor; and for correcting the control constant of said fuel injection signal and the output correction constant using said correction factors.

6. A car control apparatus, comprising:
(a) an air flow sensor for detecting an amount of air sucked into an engine;
(b) an engine speed sensor for detecting the engine speed of said engine;

(c) an injection signal generation means for obtaining an injection pulse width $T_p$ in accordance with an expression of $$T_p = K_{const} \cdot \frac{Q_a}{N}$$

where $K_{const}$ represents an injector constant, $Q_a$ represents an output of said air flow sensor, and N represents an output of said engine speed sensor;

(d) an air-fuel ration sensor for detecting an air-fuel ratio on the basis of exhaust gas components of said engine;

(e) a variation component memory for storing variation components determined on the basis of deviations between air-fuel ratio target values previously set in accordance with a plurality of predetermined operating conditions of said engine and air-fuel ratio detection values detected by said air-fuel ratio detection sensor under a plurality of corresponding engine operating conditions;

(f) a correction calculation means for performing a calculation for dividing said variation components in said variation component memory into at least two distinct components as correction values including a control constant component to be used for generating at least the fuel injection signal and an output correction constant component of the output $Q_a$ of said air flow sensor; and (g) a correction means for correcting the output $Q_a$ of said air flow sensor by using the correction values obtained by said correction calculation means.

7. A car control apparatus, comprising:

(a) an air flow sensor for detecting an amount of air sucked into an engine;

(b) an engine speed sensor for detecting the engine speed of said engine;

(c) an injection signal generation means for obtaining an injection pulse width $T_i$ in accordance with an expression of $$T_i = K_{const} \cdot \frac{Q_a}{N} + T_s$$

where $K_{const}$ represents an injector constant, $T_s$ represents an ineffective time constant, $Q_a$ represents an output of said air flow sensor, and N represents an output of said engine speed sensor;

(d) an air-fuel ratio sensor for detecting an air-fuel ratio on the basis of exhaust gas components of said engine;

(e) a variation component memory for storing variation components determined on the basis of deviations between air-fuel ratio target values previously set in accordance with a plurality of predetermined operating conditions of said engine and air-fuel ratio detection values detected by said air-fuel ratio detection sensor under a plurality of corresponding engine operating conditions;

(f) a correction calculation means for operating a calculation for dividing said variation components in said variation component memory into distinct components as correction values including said injector constant to be used for generating at least the fuel injection signal, inefficient time constant and an output correction constant component of the output $Q_a$ of said air flow sensor; and (g) a correction means for correcting the output $Q_a$ of said air flow sensor, said injector constant and said inefficient time constant by using the correction values obtained by said correction calculation means.

8. A car control method in an apparatus, comprising:

(a) an air flow sensor for detecting an amount of air sucked into an engine;

(b) an engine speed sensor for detecting the engine speed of said engine;

(c) an injection signal generation means for obtaining an injection pulse width T in accordance with an expression of $$T = K_{const} \cdot \frac{Q_a}{N} + T_s$$

where $K_{const}$ represents an injector constant, $T_s$ represents an ineffective time constant, $Q_a$ represents an output of said air flow sensor, and N represents an output of said engine speed sensor;

(d) an air-fuel ratio sensor for detecting an air-fuel ratio on the basis of exhaust gas components of said engine;

(e) a variation component memory for storing variation components determined on the basis of deviations between air-fuel ratio target values previously set in accordance with a plurality of predetermined operating conditions of said engine and air-fuel ratio detection values detected by said air-fuel ratio detection sensor under a plurality of corresponding engine operating conditions;

(f) a correction calculation means for operating a calculation for dividing said variation components in said variation component memory into distinct components as correction values including said injector constant to be used for generating at least the fuel injection signal, inefficient time constant and an output correction constant component of the output $Q_a$ of said air flow sensor; and (g) a correction means for correcting the output $Q_a$ of said air flow sensor, said injector constant and said inefficient time constant by using the correction values obtained by said correction calculation means;

wherein said method comprises a step determining said correction values of said constants in the following order;

(1) said ineffective time constant;

(2) said air flow sensor output characteristic correction constants; and (3) said injector constant.

9. An engine control apparatus comprising at least two sensors, including an air-fuel ratio sensor and at least one engine controlling actuator, in which deviations between air-fuel ratio target values previously set in accordance with a plurality of predetermined operating conditions of said engine and air-fuel ratio detection values actually detected by said air-fuel ratio detection sensor under a plurality of corresponding engine operating conditions are calculated and held as a plurality of predetermined air-fuel ratio correction factors so that said actuator is controlled by using said air-fuel ratio correction factors to perform feedback control, said engine control apparatus further comprising a calculated processing means for calculating characteristic correction factors for a detection value of the engine operating condition detected by at least one of said sensors and characteristic correction factors for control characteristic of said at least one actuator separately from each other on the basis of at least two air-fuel ratio correction factors in the different engine operating conditions among said calculated and held plurality of predetermined air-fuel ratio correction factors, whereby abnormality is judged on the corresponding sensor and actuator by using the numerical values of said characteristic correction factors.

10. A car control apparatus comprising:

(a) an air flow sensor for detecting an amount of air sucked into an engine;

(b) an engine speed sensor for detecting the engine speed of said engine;

(c) an injection signal generation means for obtaining an injection pulse width $T_p$ in accordance with an expression of $$T_p = K_{const} \cdot \frac{Q_a}{N}$$

where $K_{const}$ represents an injector constant, $Q_a$ represents an output of said air flow sensor, and N represents an output of said engine speed sensor;

(d) an air-fuel ratio sensor for detecting an air-fuel ratio on the basis of exhaust gas components of said engine;

(e) a variation components memory for storing variation components determined on the basis of deviations between air-fuel ratio target values previously set in accordance with a plurality of predetermined operating conditions of said engine and air-fuel ratio detection values detected by said air-fuel ratio detection sensor under a plurality of corresponding engine operating conditions;

(f) a correction calculation means for operating a calculation for dividing said variation components in said variation component memory into at least two distinct components as correction values including a control constant component to be used for generating at least the fuel injection signal and an output correction constant component of the output $Q_a$ of said air flow sensor;

(g) a correction means for correcting the output $Q_a$ of said air flow sensor by using the correction values obtained by said correction calculation means; and (h) an ignition timing determination means for determining a fundamental ignition timing on the basis of a value of division between the corrected value of said output $Q_a$ of said air flow sensor and the output N of said engine speed sensor.

11. An engine control apparatus comprising:

(a) means for detecting and outputting parameters indicating operating condition of the engine;

(b) means for controlling operation values of said engine according to control values;

(c) feedback means for correcting said control values in order to make said outputted parameters of said detecting means close to predetermined target values;

(d) means for learning characteristics of relations between said control values and said operation values during actual operation of said engine and determining variations of the characteristics;

(e) means for determining compensation values for said control values and for said outputted parameters of said detecting means on the basis of the variations obtained by said learning means; and (f) means for revising or compensating said control values and said outputted parameters of said detecting means according to said compensation values for said control values and for said outputted parameters of said detecting means.

* * * * *